US010830232B2

(12) United States Patent
Kim et al.

(10) Patent No.: US 10,830,232 B2
(45) Date of Patent: Nov. 10, 2020

(54) LINEAR COMPRESSOR

(71) Applicant: LG Electronics Inc., Seoul (KR)

(72) Inventors: Hyunsoo Kim, Seoul (KR); Geonwoo Kim, Seoul (KR); Chulgi Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 114 days.

(21) Appl. No.: 16/249,417

(22) Filed: Jan. 16, 2019

(65) Prior Publication Data

US 2019/0309746 A1 Oct. 10, 2019

(30) Foreign Application Priority Data

Apr. 10, 2018 (KR) ..... 10-2018-0041729

(51) Int. Cl.

| | |
|---|---|
| ***F04B 35/04*** | (2006.01) |
| ***F04B 53/04*** | (2006.01) |
| ***F04B 39/08*** | (2006.01) |
| ***F04B 39/12*** | (2006.01) |

(52) U.S. Cl.

CPC ..... *F04B 53/04* (2013.01); *F04B 35/04* (2013.01); *F04B 39/08* (2013.01); *F04B 39/121* (2013.01); *F04B 39/123* (2013.01)

(58) Field of Classification Search

CPC ..... F04B 35/04; F04B 35/054; F04B 39/127
See application file for complete search history.

(56) References Cited

U.S. PATENT DOCUMENTS 4,416,594 A * 11/1983 Ichikawa ..... F04B 39/127 248/606
4,632,645 A * 12/1986 Kawakami ..... F04B 35/045 310/27
6,273,688 B1 * 8/2001 Kawahara ..... F04B 35/045 417/363

(Continued)

FOREIGN PATENT DOCUMENTS

CN 107339206 11/2017
CN 107339211 11/2017

(Continued)

OTHER PUBLICATIONS

European Search Report in European Application No. 18192839.1, dated Nov. 22, 2018, 5 pages.

*Primary Examiner* — Patrick Hamo
(74) *Attorney, Agent, or Firm* — Fish & Richardson P.C.

(57) ABSTRACT

A linear compressor includes a shell, a discharge pipe coupled to the shell, a compressor main body located inside of the shell, a cover housing that defines a discharge space that discharges refrigerant to the discharge pipe, and a guide pipe coupled to the cover housing and configured to guide refrigerant from the discharge space to the discharge pipe. The cover housing includes a flange portion configured to couple to the compressor main body, a chamber portion that extends from the flange portion and that defines the discharge space, an accommodation groove configured to accommodate the guide pipe, and a communication groove that penetrates an inner wall of the accommodation groove and that extends to the discharge space. The guide pipe is configured to insert into the communication groove in a state in which the guide pipe is accommodated in the accommodation groove.

20 Claims, 12 Drawing Sheets

(56) References Cited

U.S. PATENT DOCUMENTS

| | | | | |
|---|---|---|---|---|
| 6,361,293 | B1 * | 3/2002 | Harper | F04C 23/008 417/312 |
| 8,348,218 | B2 * | 1/2013 | Logan | H02K 5/24 248/638 |
| 2005/0257554 | A1 * | 11/2005 | Yun | F25D 23/006 62/295 |
| 2015/0184651 | A1 * | 7/2015 | Ki | F04B 35/045 417/349 |
| 2017/0298913 | A1 * | 10/2017 | Kim | F04B 53/16 |
| 2017/0321682 | A1 * | 11/2017 | Kang | F04B 39/121 |

FOREIGN PATENT DOCUMENTS

| | | |
|---|---|---|
| CN | 107339223 | 11/2017 |
| KR | 2017-0124893 | 11/2017 |

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0041729, filed on Apr. 10, 2018, which is hereby incorporated by reference in its entirety.

FIELD

The present disclosure relates to a linear compressor.

BACKGROUND

A compressor is a mechanical device that can receive power from a power generating device such as an electric motor or a turbine to increase pressure by compressing air, refrigerant, or various other operating gases. Compressors are used in various household appliances and industry.

The compressors can be classified into reciprocating compressors, rotary compressors, and scroll compressors.

A linear compressor may improve its compression efficiency without mechanical loss that may occur when rotary motion of the motor is converted into linear motion. For example, a piston of a linear compressor may be directly connected to a driving motor that causes the piston to reciprocate linearly, and such linear compressor may have a simple structure among the reciprocating compressors.

The linear compressor may be configured to suction and compress refrigerant while the piston is linearly reciprocated within a cylinder by a linear motor in a closed shell, and then discharge refrigerant.

In some cases, a linear compressor may include a discharge cover and a cover pipe that connects a discharge pipe provided in a shell.

In some cases, a cover discharge portion may be formed on one side of the discharge cover that forms the refrigerant discharge space. One end portion of the cover pipe is coupled to the cover discharge portion, and the other end portion of the cover pipe is coupled to a discharge pipe provided in the shell. The refrigerant compressed in a course of the reciprocating motion of the piston may move to the cover discharge portion through the discharge cover and discharge to the discharge pipe through the cover pipe connected to the cover discharge portion.

In some cases, refrigerant may leak through a gap that may be formed in the connection portion between the cover discharge portion and the cover pipe.

In some examples, in order to reduce such refrigerant leakage, a coupling portion of the cover pipe is inserted into the cover discharge portion, and a caulking process is performed to reduce a gap generated between the cover discharge portion and the cover pipe to reduce the leakage of refrigerant.

In some cases, coupling portions of the cover discharge portion and the cover pipe may be made of steel in order to prevent the components from being damaged in the course of performing the caulking process.

In some cases where any one of coupling portions between the cover discharging portion and the cover pipe connecting portion is not formed of a steel material, the coupling portions between the cover discharging portion and the loop pipe may break to cause a gap, and as a result, refrigerant may leak through the gap.

SUMMARY

One objective of the present disclosure is to provide a linear compressor that can maintain airtightness between a discharge portion of a discharge cover and a cover pipe even if the discharge cover is not formed of a steel material.

Another objective of the present disclosure is to provide a linear compressor in which a cover pipe can be easily engaged and disengaged from a discharge cover.

Another objective of the present disclosure is to provide a linear compressor that prevents the cover pipe coupled to the discharge cover from easily falling off even when subjected to an external impact.

Another objective of the present disclosure is to provide a linear compressor in which a discharge cover of an existing steel material is manufactured by aluminum die-casting and can attain a noise reduction effect equal to or higher than that of existing ones.

According to one aspect of the subject matter described in this application, a linear compressor includes a shell, a discharge pipe coupled to the shell and configured to discharge refrigerant, a compressor main body located inside of the shell and configured to compress refrigerant, a cover housing that defines a discharge space configured to receive refrigerant from the compressor main body and to discharge refrigerant to the discharge pipe, and a guide pipe coupled to the cover housing and configured to guide refrigerant from the discharge space to the discharge pipe. The cover housing includes a flange portion configured to couple to the compressor main body, a chamber portion that extends from the flange portion, that defines the discharge space, and that has a front surface that is closed, an accommodation groove recessed rearward from the front surface of the chamber portion and configured to accommodate the guide pipe, and a communication groove that penetrates an inner wall of the accommodation groove and that extends to the discharge space. The guide pipe is configured to insert into the communication groove in a state in which the guide pipe is accommodated in the accommodation groove.

Implementations according to this aspect may include one or more of the following features. For example, the chamber portion may include a pipe coupling portion that extends outward from an outer circumferential surface of the chamber portion and that defines at least a portion of the accommodation groove. The guide pipe may be configured to, based on passing through a portion of the pipe coupling portion, insert into the accommodation groove. The pipe coupling portion may define a guide slit that extends from the outer circumferential surface of the chamber portion to the accommodation groove and that is configured to guide the guide pipe into the accommodation groove. In some implementations, the guide slit faces the communication groove.

In some implementations, the guide pipe includes a first coupling portion configured to insert into the communication groove, a second coupling portion configured to insert into the discharge pipe, and a connection pipe that connects the first coupling portion to the second coupling portion, where the first coupling portion is configured to be accommodated in the accommodation groove through the guide slit. In some examples, the first coupling portion includes a connection member having a first portion configured to insert into the communication groove and a second portion configured to insert into the connection pipe, a pipe cover that surrounds a periphery of the connection member based on insertion of the connection member into the connection pipe, and an elastic member located between the connection member and the pipe cover.

In some implementations, the elastic member is located at a circumferential surface of the pipe cover that surrounds the periphery of the connection member. In some examples, the elastic member has a first portion configured to insert into the communication groove and a second portion configured to be exposed to the accommodation groove. In some examples, the pipe cover includes a first cover that surrounds a portion of the connection pipe, and a second cover that extends from the first cover and that surrounds a portion of the connection member. An outer diameter of the first cover may be greater than an outer diameter of the second cover, and the elastic member may be configured to couple to an outer circumferential surface of the second cover.

In some implementations, a portion of the second cover is configured to insert into the communication groove, where the elastic member is configured to be positioned between the outer circumferential surface of the second cover and an inner circumferential surface of the communication groove. In some examples, the pipe cover is configured to, based on insertion of the first coupling portion into the communication groove, contact the inner wall of the accommodation groove by elastic force applied by the elastic member.

In some implementations, the first cover has a polyhedral shape having a first width in a first direction and a second width in a second direction, the second width being greater than the first width, where a width of the guide slit is greater than the first width and less than the second width. In some examples, the guide pipe has a first end portion configured to insert into the communication groove and a second end portion configured to insert into the discharge pipe. The guide pipe may be configured to rotate with respect to the accommodation groove by a predetermined angle in a state in which the first end portion is inserted into the communication groove, and the second end portion may be configured to insert into the discharge pipe in a state in which the first end portion is inserted into the communication groove.

In some implementations, the front surface of the chamber portion defines a recessed portion that is configured to receive the guide pipe arranged about the chamber portion and that allows the guide pipe to avoid interference with the chamber portion.

In some implementations, the cover housing is manufactured by aluminum die-casting. For example, the cover housing may be integrally manufactured by aluminum die-casting.

In some implementations, the compressor main body includes one or more of a frame located inside of the shell, the frame comprising a frame head and a frame body that extends from a center of a rear surface of the frame head in a longitudinal direction of the shell, a cylinder that is configured to insert into the frame body through the frame head and that defines a compression space at a front end portion of the cylinder, a piston located inside of the cylinder and configured to move relative to the cylinder to compress refrigerant in the compression space, a motor assembly configured to drive the piston to move relative to the cylinder in an axial direction of the cylinder, and a discharge valve located at a front surface of the cylinder and configured to selectively open and close at least a portion of the compression space.

In some implementations, the linear compressor may further include a discharge cover configured to insert into a rear surface of the cover housing and configured to cover an opening defined at the rear surface of the cover housing, the compressor main body further includes a valve spring assembly configured to insert inside of the discharge cover and configured to provide elastic force that causes the discharge valve to contact the front surface of the cylinder.

In some implementations, the chamber portion of the cover housing defines an opening at a rear surface of the chamber portion that faces a front surface of the compressor main body. In some implementations, the cover housing partitions the discharge space into a plurality of discharge chambers that communicate with each other, where the discharge pipe is configured to connect to at least one of the plurality of discharge chambers.

In some implementations, since the guide pipe is inserted into the communication groove in a state of being accommodated in the accommodation groove, airtightness between the discharge portion of the discharge cover and the cover pipe can be maintained even if the cover housing is not made of steel.

In some implementations, the guide pipe may be accommodated in the accommodation groove through a portion of the pipe coupling portion.

In some implementations, since the guide slit is formed at a position facing the communication groove, the guide pipe can be inserted at a time in a direction to be inserted into the communication groove.

DETAILED DESCRIPTION

Reference will now be made in detail to implementations of the present disclosure, examples of which are illustrated in the accompanying drawings.

Hereinafter, a linear compressor according to an implementation of the present disclosure will be described in detail with reference to the drawings.

Figure 1:
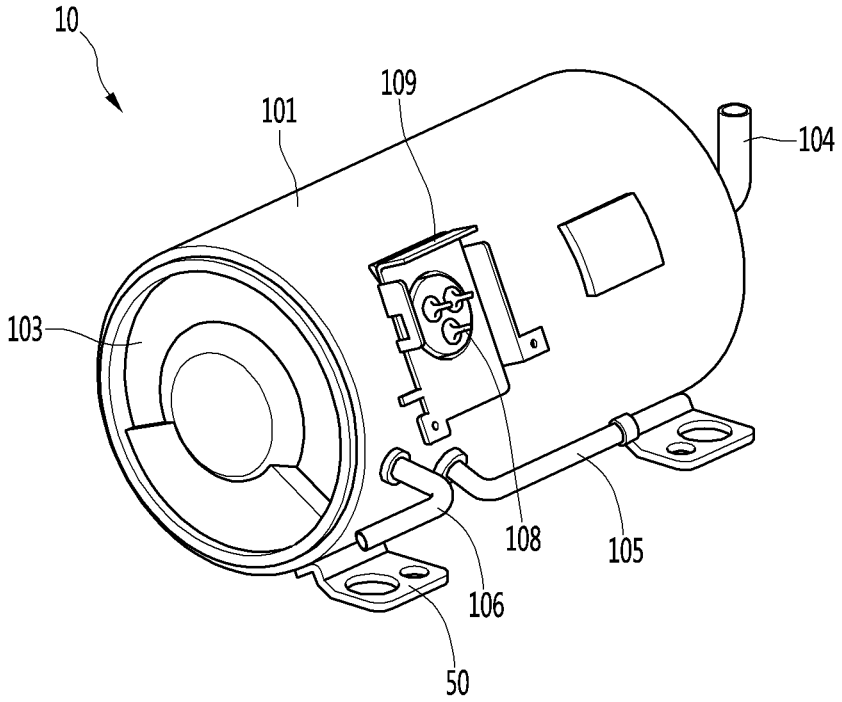
FIG. 1 is a perspective view illustrating an example linear compressor.

FIG. 1 is a perspective view of an example linear compressor according to a first implementation of the present disclosure.

With reference to FIG. 1, a linear compressor 10 may include a cylindrical shell 101 and a pair of shell covers coupled to both end portions of the shell 101. The pair of shell covers may include a first shell cover 102 (see FIG. 3) on a refrigerant suction side and a second shell cover 103 on a refrigerant discharge side.

In detail, the legs 50 can be coupled to the lower side of the shell 101. The legs 50 may be coupled to the base of the product in which the linear compressor 10 is installed. In one example, the product may include a refrigerator, and the base may include a machine room base of the refrigerator. As another example, the product may include an outdoor unit of the air conditioner, and the base may include a base of the outdoor unit.

The shell 101 has a lying cylindrical shape and is advantageous in that the height of the machine room can be reduced when the linear compressor 10 is installed in the machine room base of the refrigerator. In other words, the longitudinal center axis of the shell 101 coincides with the central axis of the compressor main body, which will be described below, and the central axis of the compressor main body coincides with the central axis of the cylinder and the piston constituting the compressor main body.

A terminal block 108 may be installed on the outer surface of the shell 101. The terminal block 108 can be understood as a connecting portion for transmitting external power to the motor assembly 140 (see FIG. 3) of the linear compressor.

A bracket 109 is installed on the outside of the terminal 108. The bracket 109 may function to protect the terminal 108 from an external impact or the like.

Both end portions of the shell 101 are configured to be opened. The first shell cover 102 and the second shell cover 103 may be coupled to both opened end portions of the shell 101. By the shell covers 102 and 103, the inner space of the shell 101 can be sealed.

With reference to FIG. 1, the first shell cover 102 is located on the right side portion (or rear end portion) of the linear compressor 10, and the second shell cover 103 is located on the left side portion (or the front end portion) of the linear compressor 10. The end portion of the shell 101 on which the first shell cover 102 is mounted can be defined as the suction side end portion and the end portion of the shell 101 on which the second shell cover 103 is mounted can be defined as a discharge side end portion.

The linear compressor 10 may further include a plurality of pipes 104, 105, and 106 provided in the shell 101 or the shell covers 102 and 103. The refrigerant flows into the shell 101 through the plurality of pipes 104, 105, and 106, is compressed therein, and then is discharged to the outside of the shell 101.

In detail, the plurality of pipes 104, 105, and 106 may include a suction pipe 104 for allowing the refrigerant to be sucked into the linear compressor 10, a discharge pipe 105 for discharging the compressed refrigerant from the linear compressor 10, and a process pipe 106 for replenishing the linear compressor 10 with a refrigerant.

For example, the suction pipe 104 may be coupled to the first shell cover 102, and the refrigerant may be sucked into the linear compressor 10 along the axial direction through the suction pipe 104.

The discharge pipe 105 may be coupled to the outer circumferential surface of the shell 101. The refrigerant sucked through the suction pipe 104 can be compressed while flowing in the axial direction. The compressed refrigerant can be discharged to the outside through the discharge pipe 105. The discharge pipe 105 may be disposed at a position adjacent to the second shell cover 103 than the first shell cover 102.

The process pipe 106 may be coupled to the outer circumferential surface of the shell 101. The operator can inject the refrigerant into the linear compressor 10 through the process pipe 106.

The process pipe 106 may be coupled to the shell 101 at a different height than the discharge pipe 105 to avoid interference with the discharge pipe 105. The height may be defined as a distance reaching the discharge pipe 105 and the process pipe 106 from the leg 50 in the up and down direction (or the radial direction of the shell), respectively. The discharge pipe 105 and the process pipe 106 are coupled to the outer circumferential surface of the shell 101 at different heights, thereby facilitating the operation for injecting the refrigerant.

A cover support portion 102*a* (see FIG. 3) may be provided at the center of the inner surface of the first shell cover 102. A second support device 185, which will be described below, may be coupled to the cover support portion 102*a*. The cover support portion 102*a* and the second support device 185 can be understood as devices for supporting the rear end of the compressor main body so that the compressor main body maintains a horizontal state inside the shell 101. Here, the main body of the compressor refers to a set of components provided inside the shell 101, and may include, for example, a driving unit moving forward and backward and a support portion supporting the driving unit.

Figure 2:
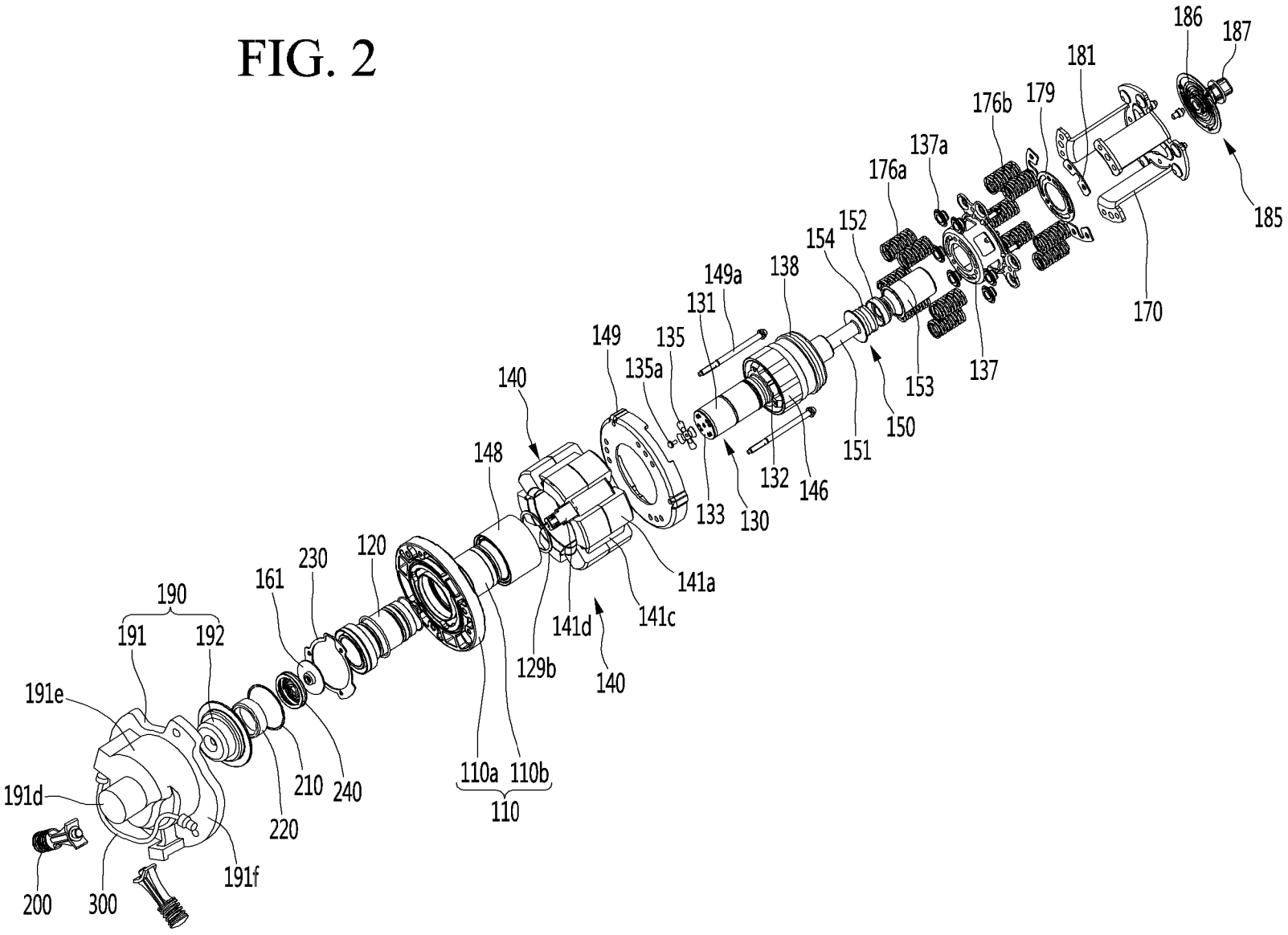
FIG. 2 is an exploded perspective view illustrating an example compressor main body accommodated in an example shell of an example compressor.
Figure 3:
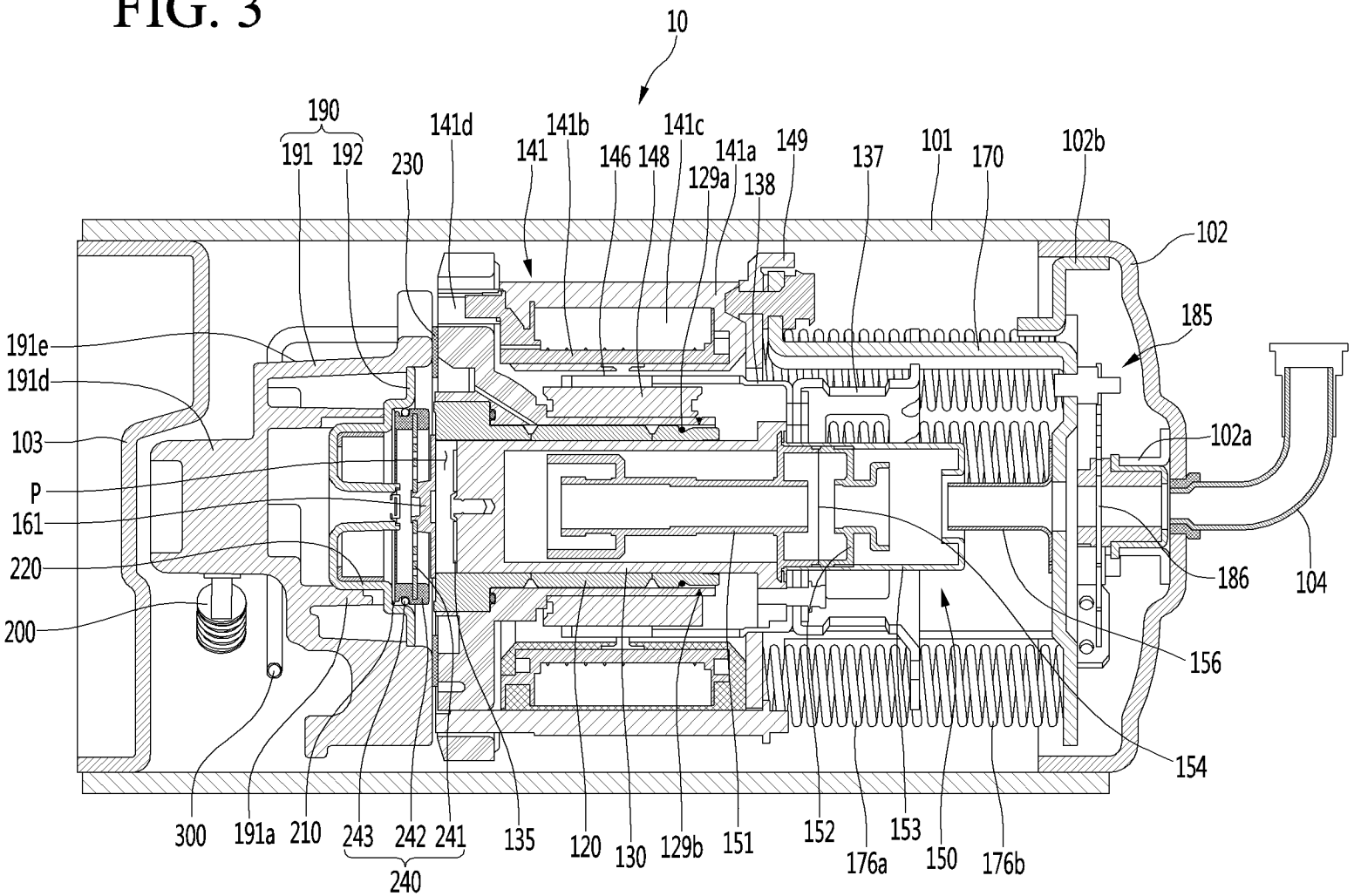
FIG. 3 is a longitudinal sectional view illustrating an example compressor.

The driving unit may include components such as a piston 130, a magnet frame 138, a permanent magnet 146, a supporter 137, and a suction muffler 150, as illustrated in FIGS. 2 and 3. The support portion may include components such as resonance springs 176*a* and 176*b*, a rear cover 170, a stator cover 149, a first support device 200 and a second support device 185.

A stopper 102*b* (see FIG. 3) may be provided on the inner surface of the first shell cover 102 at an edge thereof. The stopper 102*b* is configured to prevent the main body of the compressor, in particular, the motor assembly 140 from being damaged by collision with the shell 101 due to shaking, vibration or impact generated during transportation of the linear compressor 10. Since the stopper 102*b* is located adjacent to a rear cover 170 to be described below so that when the linear compressor 10 is shaken, the rear cover 170 interferes with the stopper 102*b*, it is possible to prevent the impact from being directly transmitted to the motor assembly 140.

FIG. 2 is an exploded perspective view of an example compressor main body accommodated in an example shell of an example compressor according to the first implementation of the present disclosure, and FIG. 3 is a longitudinal sectional view of an example compressor according to the first implementation of the present disclosure.

With reference to FIGS. 2 and 3, the main body of the linear compressor 10 provided inside the shell 101 includes a frame 110, a cylinder 120 which is fitted into a center of the frame 110, a piston 130 that reciprocates linearly in the cylinder 120, and a motor assembly 140 that applies a driving force to the piston 130. The motor assembly 140 may be a linear motor that linearly reciprocates the piston 130 in the axial direction of the shell 101.

In detail, the linear compressor 10 may further include a suction muffler 150. The suction muffler 150 is coupled to the piston 130 and is provided to reduce noise generated from the refrigerant sucked through the suction pipe 104. The refrigerant sucked through the suction pipe 104 flows into the piston 130 through the suction muffler 150. For example, in the course of the refrigerant passing through the suction muffler 150, the flow noise of the refrigerant can be reduced.

The suction muffler 150 may include a plurality of mufflers. The plurality of mufflers may include a first muffler 151, a second muffler 152, and a third muffler 153 coupled to each other.

The first muffler 151 is positioned inside the piston 130 and the second muffler 152 is coupled to the rear end of the first muffler 151. The third muffler 153 accommodates the second muffler 152 therein, and the front end portion thereof may be coupled to the rear end of the first muffler 151.

The refrigerant sucked through the suction pipe 104 can pass through the third muffler 153, the second muffler 152, and the first muffler 151 in order from the viewpoint of the flow direction of the refrigerant. In this process, the flow noise of the refrigerant can be reduced.

A muffler filter 154 may be mounted on the suction muffler 150. The muffler filter 154 may be positioned at an interface at which the first muffler 151 and the second muffler 152 are coupled to each other. For example, the muffler filter 154 may have a circular shape, and an edge of the muffler filter 154 may be supported while disposing between the coupling surfaces of the first and second mufflers 151 and 152.

Here, "axial direction" can be understood as a direction coinciding with a reciprocating motion direction of the piston 130, that is, a direction in which the central axis of the cylindrical shell 101 in the longitudinal direction extends. In "axial direction", a direction from the suction pipe 104 toward the compression space P, that is, a direction in which the refrigerant flows is referred to as "frontward direction" and a direction opposite thereto is referred to as "rearward" direction". When the piston 130 moves forward, the compression space P can be compressed.

On the other hand, "radial direction" may be defined as a radial direction of the shell 101, and a direction orthogonal to a direction in which the piston 130 reciprocates.

The piston 130 may include a substantially cylindrical piston main body 131 and a piston flange portion 132 extending from the rear end of the piston main body 131 in the radial direction. The piston main body 131 reciprocates within the cylinder 120 and the piston flange portion 132 can reciprocate outside the cylinder 120. The piston main body 131 is configured to receive at least a portion of the first muffler 151.

In the cylinder 120, a compression space P in which the refrigerant is compressed by the piston 130 is formed. A plurality of suction holes 133 are formed at a point spaced apart from the center of the front surface portion of the piston main body 131 in the radial direction.

In detail, the plurality of suction holes 133 are arranged in the circumferential direction of the piston 130 to be spaced apart therefrom, and the refrigerant flows into the compression space P through the plurality of suction holes 133. The plurality of suction holes 133 may be spaced apart from each other at a predetermined interval in the circumferential direction of the front surface portion of the piston 130 or may be formed of a plurality of groups.

In addition, a suction valve 135 for selectively opening the suction hole 133 is provided in front of the suction hole 133. The suction valve 135 is fixed to the front surface of the piston main body 131 by a fastening member 135*a* such as a screw or a bolt.

In detail, on the other hand, in front of the compression space P, there are provided a discharge cover unit 190 for forming a discharge space for the refrigerant discharged from the compression space P and a discharge valve assembly for discharging refrigerant compressed in the compression space P to the discharge space.

The discharge cover unit 190 may be provided in a form in which a plurality of covers are stacked. A fastening hole or fastening groove 191*w* (see FIG. 8) for coupling the first support device 200, which will be described below, may be formed on the outermost (or frontmost) one of the plurality of covers.

In detail, the discharge cover unit 190 includes a cover housing 191 fixed to the front surface of the frame 110 and a discharge cover 192 disposed inside the cover housing 191. The discharge cover unit 190 may further include a cylindrical fixing ring 220 which is in close contact with the inner circumferential surface of the discharge cover 192. The fixing ring 220 is made of a material having a thermal expansion coefficient different from that of the discharge cover 192 to prevent the discharge cover 192 from being separated from the cover housing 191.

In other words, the fixing ring 220 is made of a material having a thermal expansion greater coefficient than that of the discharge cover 192 and is expanded while receiving heat from the refrigerant discharged from the compression space P, So that the discharge cover 192 can be strongly in close contact with the cover housing 191. Thus, the possibility that the discharge cover 192 is detached from the cover housing 191 can be reduced. For example, the discharge cover 192 may be made of high-temperature-resistant engineering plastic, the cover housing 191 may be made of aluminum die-cast, and the fixing ring 220 may be made of stainless steel.

In some implementations, the discharge valve assembly may include a discharge valve 161 and a spring assembly 240 that provides an elastic force in a direction in which the discharge valve 161 is in close contact with the front end of the cylinder 120.

In detail, the discharge valve 161 is separated from the front surface of the cylinder 120 when the pressure in the compression space P becomes equal to or higher than the discharge pressure, and the compressed refrigerant is discharged into the discharge space (or discharge chamber) which is formed in the discharge cover 192.

The spring assembly 240 may include a valve spring 242 in a form of a leaf spring, a spring support portion 241 surrounding the edge of the valve spring 242 to support the valve spring 242, and a friction ring 243 fitted to the outer circumferential surface of the spring support portion 241.

When the pressure in the compression space P becomes equal to or higher than the discharge pressure, the valve spring 242 is elastically deformed toward the discharge cover 192 so that the discharge valve 161 is spaced apart from the front end portion of the cylinder 120.

The center of the front surface of the discharge valve 161 is fixedly coupled to the center of the valve spring 242 and the rear surface of the discharge valve 161 is in close contact with the front surface (or front end) of the cylinder 120 by the elastic force of the valve spring 242.

When the discharge valve 161 is supported on the front surface of the cylinder 120, the compression space P is maintained in a closed state and when the discharge valve 161 is spaced apart from the front surface of the cylinder

120, the compression space P is opened so that the compressed refrigerant in the compression space P can be discharged.

The compression space P is understood as a space formed between the suction valve 135 and the discharge valve 161. The suction valve 135 is formed on one side of the compression space P and the discharge valve 161 is provided on the other side of the compression space P, that is, on the opposite side of the suction valve 135.

When the pressure of the compression space P becomes equal to or lower than the suction pressure of the refrigerant in a process of linearly reciprocating the piston 130 in the cylinder 120, the suction valve 135 is opened, and the refrigerant enters the compression space P.

On the other hand, when the pressure in the compression space P becomes equal to or higher than the suction pressure of the refrigerant, the suction valve 135 is closed and the refrigerant in the compression space P is compressed by advancing the piston 130.

In some implementations, when the pressure in the compression space P is larger than the pressure (discharge pressure) in the discharge space, the valve spring 242 is deformed forward and the discharge valve 161 is separated from the cylinder 120. The refrigerant in the compression space P is discharged into a discharge space formed in the discharge cover 192 through a spaced gap between the discharge valve 161 and the cylinder 120.

When the discharge of the refrigerant is completed, the valve spring 242 provides a restoring force to the discharge valve 161 so that the discharge valve 161 is in close contact with the front end of the cylinder 120 again.

In addition, a gasket 210 is provided on the front surface of the spring support portion 241 so that, when the discharge valve 161 is opened, generation of noise by direct impact with the spring assembly 240 and the discharge cover while the spring assembly 240 is moved in the axial direction can be prevented.

In some implementations, the linear compressor 10 may further include a guide pipe 300. The guide pipe 300 is coupled to the cover housing 191 and discharges the refrigerant discharged from the compression space P to the discharge space inside the discharge cover unit 190 to the outside.

To this end, one end portion of the guide pipe 300 is coupled to the cover housing 191 and the other end portion of the guide pipe 300 is coupled to the discharge pipe 105 formed in the shell 101. Accordingly, the refrigerant passed through the cover housing 191 is discharged to the discharge pipe 105 through the guide pipe 300.

The detailed structure of the guide pipe 300 will be described below.

The frame 110 can be understood as a configuration for fixing the cylinder 120. For example, the cylinder 120 may be inserted in the axial direction of the shell 101 at the center portion of the frame 110. The discharge cover unit 190 may be coupled to the front surface of the frame 110 by a fastening member.

In addition, a heat insulating gasket 230 may be interposed between the cover housing 191 and the frame 110. In detail, the heat insulating gasket 230 is placed on the rear surface of the cover housing 191 or the front surface of the frame 110 in contact with the rear end so that conduction of the heat of the discharge cover unit 190 to the frame 110 can be minimized.

In some implementations, the motor assembly 140 may include an outer stator 141 fixed to the frame 110 so as to surround the cylinder 120, an inner stator 148 disposed to be spaced inward from the outer stator 141, and a permanent magnet 146 positioned in the space between the outer stator 141 and the inner stator 148.

The permanent magnets 146 can reciprocate linearly in the axial direction by the mutual electromagnetic force generated between the outer stator 141 and the inner stator 148. The permanent magnet 146 may be configured with a single magnet having one pole or a plurality of magnets having three poles.

The magnet frame 138 may have a cylindrical shape with a front surface opened and a rear surface closed. The permanent magnet 146 may be coupled to an end portion of the opened front surface of the magnet frame 138 or an outer circumferential surface of the magnet frame 138. A through-hole through which the suction muffler 150 passes may be formed at the rear center of the magnet frame 138 and the suction muffler 150 may be fixed to the rear surface of the magnet frame 138.

In some examples, the piston flange portion 132 extending in the radial direction from the rear end of the piston 130 is fixed to the rear surface of the magnet frame 138. The rear end edge of the first muffler 151 is interposed between the piston flange portion 132 and the rear surface of the magnet frame 138 and fixed to the center of the rear surface of the magnet frame 138.

When the permanent magnet 146 reciprocates in the axial direction, the piston 130 can reciprocate axially with the permanent magnet 146 as one body.

The outer stator 141 may include a coil winding body and a stator core 141*a*. The coil winding body includes a bobbin 141*b*, a coil 141*c* wound around the bobbin 141*b* in the circumferential direction, and a terminal portion 141*d* for guiding so that a power line connected to the coil 141*c* is pulled out or exposed to the outside of the outer stator 141.

The stator core 141*a* may include a plurality of core blocks formed by stacking a plurality of '□'-shaped lamination plates in a circumferential direction. The plurality of core blocks may be arranged to surround at least a portion of the coil winding body.

A stator cover 149 is provided at one side of the outer stator 141. In detail, the front end portion of the outer stator 141 is fixed to the frame 110, and the stator cover 149 is fixed to the rear end portion thereof.

A bar-shaped cover-fastening member 149*a* passes through the stator cover 149 and is inserted and fixed to the frame 110 through an edge of the outer stator 141. In other words, the motor assembly 140 is stably fixed to the rear surface of the frame 110 by the cover-fastening member 149*a*.

The inner stator 148 is fixed to the outer periphery of the frame 110. The inner stator 148 is configured by stacking a plurality of lamination plates from the outside of the frame 110 in the circumferential direction.

In some implementations, the frame 110 may include a frame head 110*a* in the form of a disk and a frame body 110*b* extending from the center of the rear surface of the frame head 110*a* and accommodating the cylinder 120 therein. The discharge cover unit 190 is fixed to the front surface of the frame head 110*a* and the inner stator 148 is fixed to the outer circumferential surface of the frame body 110*b*. The plurality of lamination plates constituting the inner stator 148 are stacked in the circumferential direction of the frame body 110*b*.

The linear compressor 10 may further include a supporter 137 for supporting a rear end of the piston 130. The supporter 137 is coupled to the rear side of the piston 130 and a hollow portion may be formed inside the supporter 137 to allow the suction muffler 150 to pass therethrough.

The supporter 137 is fixed to the rear surface of the magnet frame 138. The piston flange portion 132, the magnet frame 138, and the supporter 137 are coupled to each other in one body together by the fastening member.

A balance weight 179 can be coupled to the supporter 137. The weight of the balance weight 179 may be determined based on the operating frequency range of the compressor main body.

The linear compressor 10 may further include a rear cover 170. The front end of the rear cover 170 is fixed to the stator cover 149 and extends rearward and is supported by the second support device 185.

In detail, the rear cover 170 may include three support legs, and the front surface portion (or the front end portion) of the three support legs may be coupled to the rear surface of the stator cover 149. A spacer 181 may be interposed between the three support legs and the rear surface of the stator cover 149. The distance from the stator cover 149 to the rear end portion of the rear cover 170 can be determined by adjusting the thickness of the spacer 181.

The linear compressor 10 may further include an inlet guide unit 156 coupled to the rear cover 170 and guiding the inflow of the refrigerant into the suction muffler 150. The front end portion of the inlet guide part 156 may be inserted into the suction muffler 150.

The linear compressor 10 may include a plurality of resonance springs whose natural frequencies are adjusted so that the piston 130 can resonate.

In detail, the plurality of resonance springs may include a plurality of first resonance springs 176*a* interposed between the supporter 137 and the stator cover 149 and a plurality of second resonance springs 176*b* interposed between the supporters 137 and the rear cover 170.

By the action of the plurality of resonance springs, a stable linear reciprocating motion of the piston 130 within the shell 101 of the linear compressor 10 is enabled and the generation of vibration or noise caused by the movement of the piston 130 can be minimized.

The supporter 137 may include a spring insertion member 137*a* into which the rear end of the first resonance spring 176*a* is inserted.

The linear compressor 10 may include a plurality of sealing members for increasing a coupling force between the frame 110 and the components around the frame 110.

In detail, the plurality of sealing members may include a first sealing member 129*a* provided between the cylinder 120 and the frame 110 and a second sealing member 129*b* provided in a portion at which the frame 110 and the inner stator 148 are coupled.

The first and second sealing members 129*a* and 129*b* may be ring-shaped.

The linear compressor 10 may further include a pair of first support devices 200 for supporting the front end of the main body of the linear compressor 10. For example, one end of each of the pair of first support devices 200 is fixed to the discharge cover unit 190, and the other end is in close contact with the inner circumferential surface of the shell 101. The pair of second support apparatuses 200 supports the discharge cover unit 190 in a state of being opened at an angle ranging from 90 to 120 degrees.

In detail, the cover housing 191 constituting the discharge cover unit 190 may include a flange portion 191*f* tightly fixed to the front surface of the frame head 110*a*, a chamber portion 191*e* which is formed in the axial direction of the shell 101 from the inner edge of the flange portion 191*f*, a support device fixing portion 191*d* which extends further from the front surface of the chamber portion 191*e*, and a dividing sleeve 191*a* which extends inward of the chamber portion 191*e*.

The end portions of the pair of first support devices 200 are fixed to the outer circumferential surface of the support device fixing portion 191*d*, respectively. A fastening groove into which a fastening protrusion protruding from the front end portion of the first support device 200 is inserted may be formed on the outer circumferential surface of the support device fixing portion 191*d*.

In addition, the outer diameter of the support device fixing portion 191*d* may be smaller than the outer diameter of the front surface portion of the chamber portion 191*e*.

In some implementations, the linear compressor 10 may further include a second support device 185 for supporting a rear end of the compressor main body. The second support device 185 may include a second support spring 186 in the form of a circular leaf spring and a second spring support 187 that inserts into the center portion of the second support spring 186.

The outer edge of the second support spring 186 is fixed to the rear surface of the rear cover 170 by a fastening member and the second spring support portion 187 is coupled to the cover support portion 102*a* formed on the center of the first shell cover 102 and thus the rear end of the compressor main body is elastically supported at the center portion of the first shell cover 102.

Hereinafter, a discharge cover unit according to an implementation of the present disclosure will be described in detail with reference to the drawings.

Figure 4:
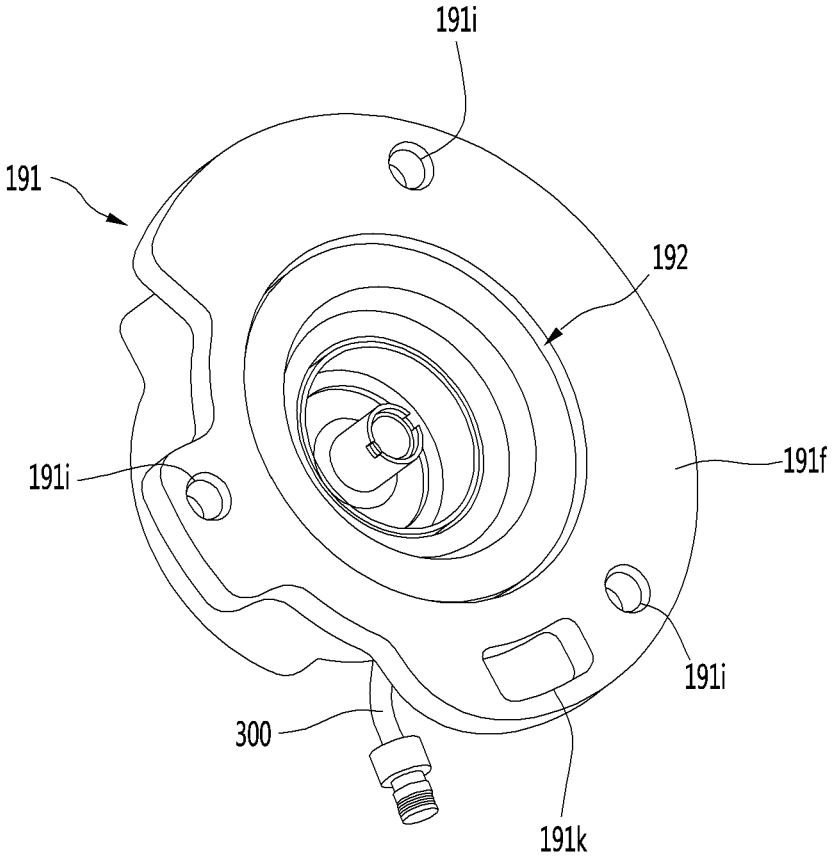
FIG. 4 is a perspective view illustrating an example discharge cover unit in which an example discharge cover and an example fixing ring are coupled to an example cover housing.
Figure 5:
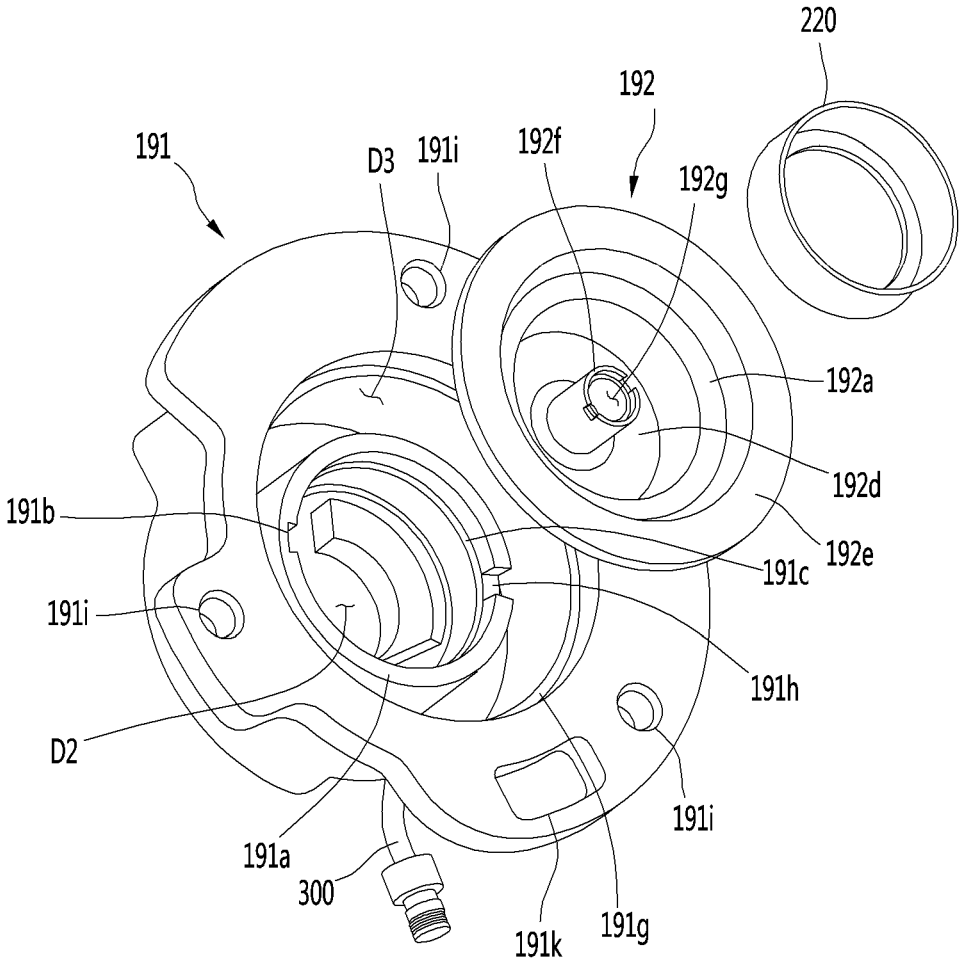
FIG. 5 is an exploded perspective view illustrating an example discharge cover unit.
Figure 6:
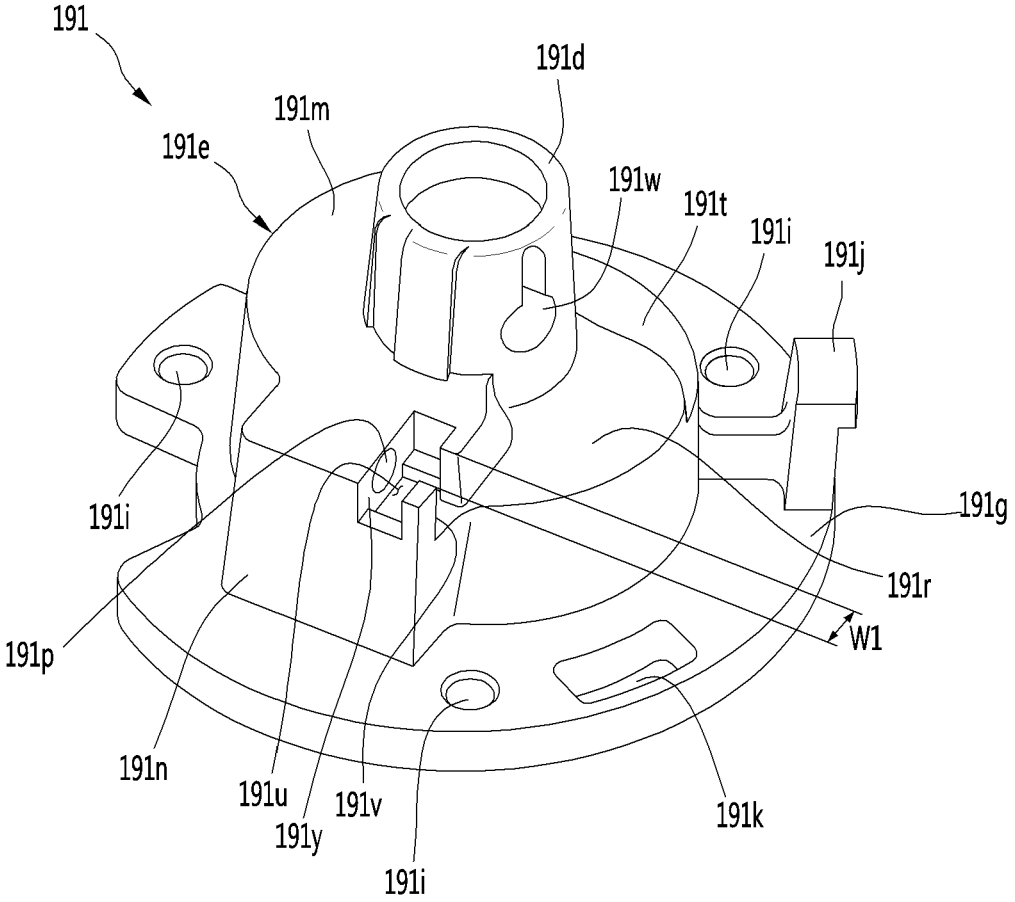
FIG. 6 is a perspective view illustrating an example cover housing.
Figure 7:
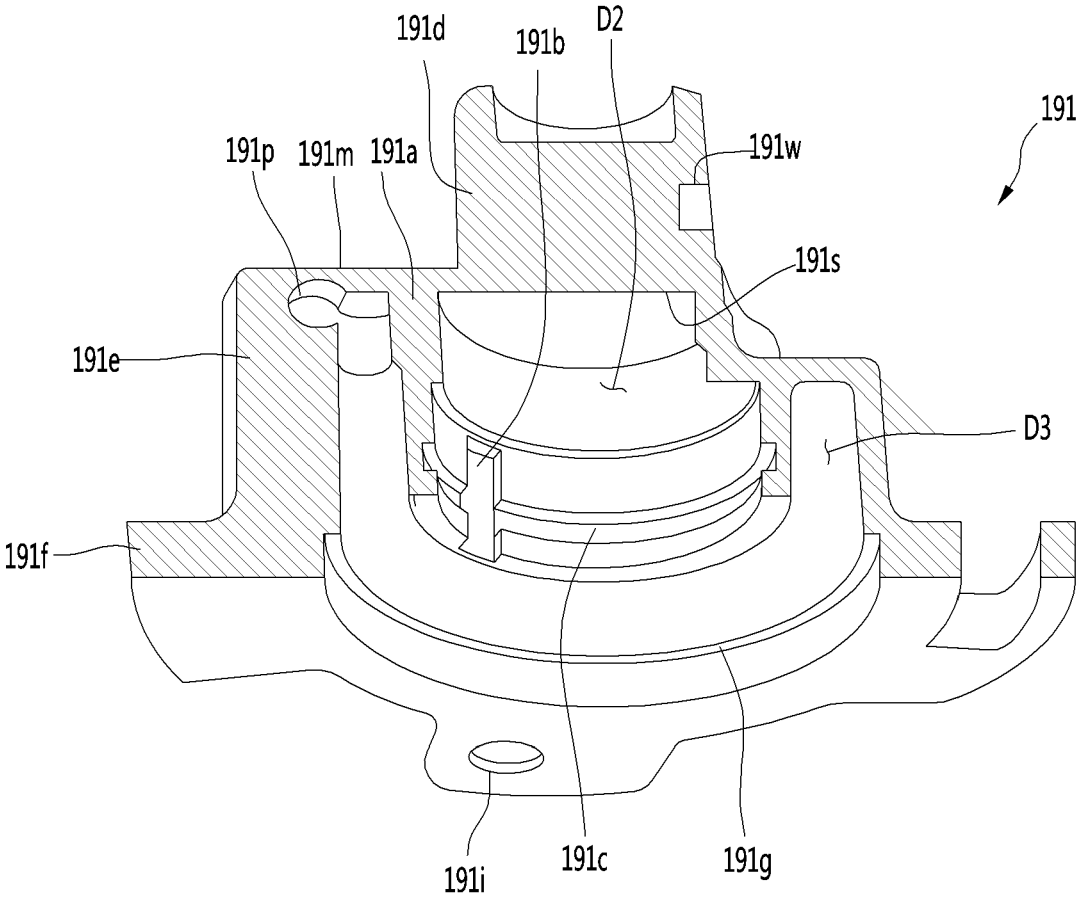
FIG. 7 is a cross-sectional perspective view illustrating an example cover housing.
Figure 8:
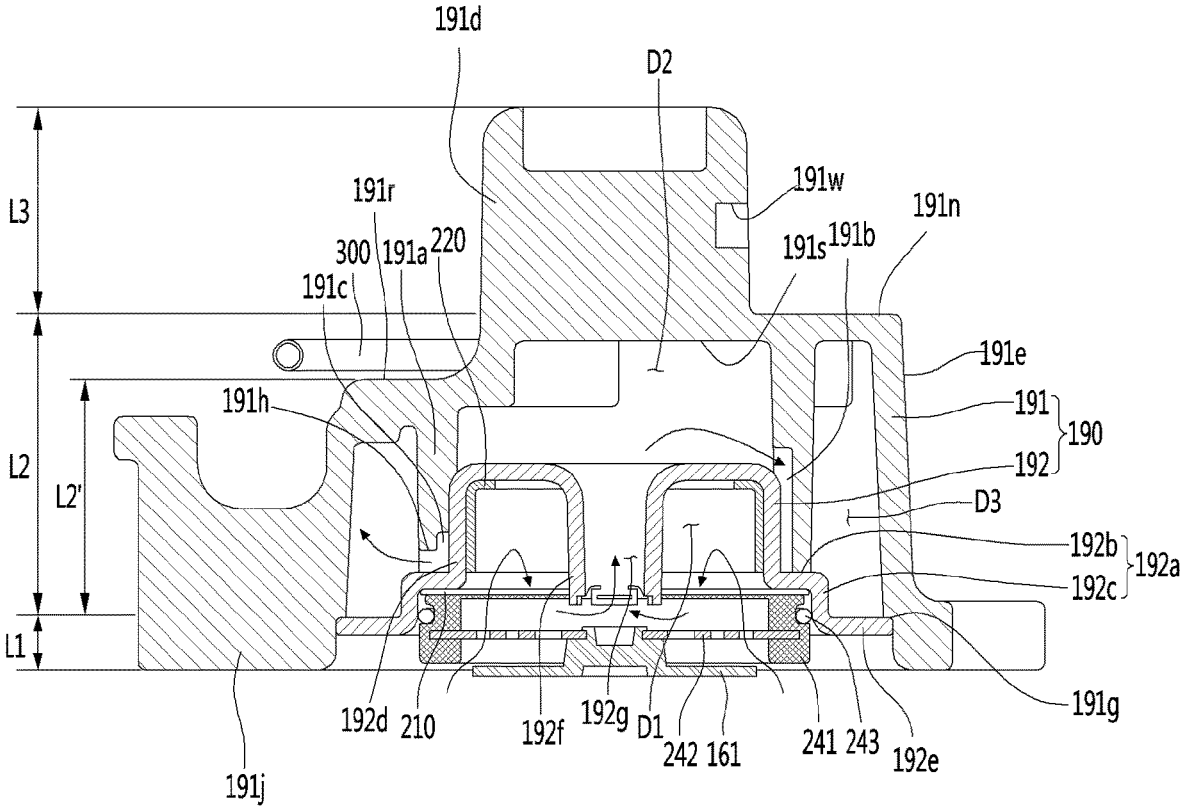
FIG. 8 is a longitudinal sectional view illustrating an example discharge cover unit.

FIG. 4 is a perspective view illustrating an example discharge cover unit in which an example discharge cover and an example fixing ring are coupled to an example cover housing, FIG. 5 is an exploded perspective view illustrating the discharge cover unit, FIG. 6 is a perspective view illustrating the cover housing, FIG. 7 is a cross-sectional perspective view illustrating the cover housing, and FIG. 8 is a longitudinal sectional view illustrating the discharge cover unit.

For convenience, with reference to FIGS. 6 and 8, the cover housing 191 and the discharge cover unit 190 are illustrated standing on the ground.

With reference to FIGS. 4 to 8, the discharge cover unit 190 includes an outer cover housing 191, a discharge cover 192 mounted on the inside of the cover housing 191, and a fixing ring 220 fitted to the inner circumferential surface of the discharge cover.

In some implementations, either one of the cover housing 191 and the discharge cover 192 may be defined as a first discharge cover 191, and the other one as a second discharge cover 192.

The cover housing 191 may be formed of die-cast aluminum, the discharge cover 192 may be formed of an engineering plastic, and the fixing ring 220 may be stainless steel. Further, the valve spring assembly 240 may be seated at the rear end of the discharge cover 192.

The cover housing 191 according to the implementation of the present disclosure is fixed to the front surface of the frame 110, and a refrigerant discharge space is formed therein.

For example, the cover housing 191 may have a container shape as a whole. In other words, the cover housing 191 forms a discharge space with the rear opened, and the discharge cover 192 can be inserted to shield the opened rear surface of the cover housing 191.

Particularly, the cover housing 191 according to the present disclosure is characterized in that it is integrally manufactured by aluminum die casting. Therefore, unlike the cover housing of the related art, the welding process can be omitted in the case of the cover housing 191 of the present disclosure. Therefore, the manufacturing process of the cover housing 191 can be simplified, resulting in minimization of product defects and cost reduction of the product. In addition, owing to the omission of the welding process, dimensional tolerance due to welding is remarkably reduced, so that there is no gap in the cover housing 191, and as a result, leakage of the refrigerant is prevented.

For example, with reference to FIGS. 4 and 5, the cover housing 191 includes a flange portion 191*f* which is tightly fixed to the front surface of the frame head 110*a*, a chamber portion 191*e* which extends in the axial direction of the shell 101 from the inner edge of the flange portion 191*f*, and a support device fixing portion 191*d* which further extends from the front surface of the chamber portion 191*e*.

The chamber portion 191*e* and the support device fixing portion 191*d* may have a cylindrical shape. The outer diameter of the chamber portion 191*e* may be smaller than the outer diameter of the flange portion 191*f* and the outer diameter of the support device fixing portion 191*d* may be smaller than the outer diameter of the chamber portion 191*e*.

The flange portion 191*f* is bent at the rear end of the chamber portion 191*e* and is in close contact with the front surface of the frame head 110*a*. In other words, the flange portion 191*f* may extend radially outward from the rear end of the chamber portion 191*e*.

In the flange portion 191*f*, a fastening hole 191*i* may be formed in the frame head 110*a* to be fastened by a fastening member.

A plurality of fastening holes 191*i* may be spaced apart from each other. For example, three fastening holes 191*i* may be disposed at equal intervals in the circumferential direction of the flange portion 191*f*. Therefore, the flange portion 191*f* is supported at three points on the frame head 110*a*, so that the cover housing 191 can be firmly fixed to the front surface of the frame 110.

In some implementations, the flange portion 191*f* may be formed with a rotation prevention hole 191*k* for preventing the cover housing 191 from rotating in a state where the cover housing 191 is mounted on the frame 110. The rotation prevention holes 191*k* may be formed to penetrate from the front surface to the rear surface of the flange portion 191*f*.

Further, the flange portion 191*f* may further include a support rib 191*j* for absorbing impact from the outside. The support ribs 191*j* may extend forward from the front surface of the flange portion 191*f*.

For example, the support rib 191*j* is provided at the front edge of the flange portion 191*f* and may extend further radially outward of the flange portion 191*f*. Therefore, in a case where the impact is generated in the linear compressor 10 (for example, in a case where the product is dropped on the ground at the time of product shipment), the cover housing 191 is prevented from directly hitting the shell 101, The amount of the impact can be reduced through the support ribs 191*j*. In addition, the support ribs 191*j* can function to find a correct position when assembling the discharge cover unit 190.

The chamber portion 191*e* extends in the axial direction of the shell 101 from the front surface of the flange portion 191*f*. For example, the chamber portion 191*e* may extend in the axial direction of the shell 101 from the inside of the through-hole formed in the flange portion 191*f*.

For example, the chamber portion 191*e* may extend in a hollow cylindrical shape. In addition, a discharge space through which the refrigerant flows may be provided in the chamber portion 191*e*.

A dividing sleeve 191*a* for dividing the inner space of the chamber portion 191*e* may be formed inside the chamber portion 191*e*.

The dividing sleeve 191*a* may extend in a cylindrical shape from the inside of the chamber portion 191*e*. For example, the dividing sleeve 191*a* may protrude rearward from the front surface 191*m* of the chamber portion 191*e*. At this time, the outer diameter of the dividing sleeve 191*a* is smaller than the outer diameter of the chamber portion 191*e*. Accordingly, the inner space of the chamber portion 191*e* can be divided by the dividing sleeve 191*a*.

On the other side, the dividing sleeve 191*a* may extend from the rear surface 191*s* of the front surface 191*m* of the chamber portion 191*e* to the rear of the chamber portion 191*e*.

In this implementation, the space corresponding to the inside of the dividing sleeve 191*a* is defined as a second discharge chamber D2, and the outer space of the dividing sleeve 191*a* can be defined as a third discharge chamber D3. In other words, it can be determined that the discharge space of the chamber portion 191*e* is divided into the second discharge chamber D2 and the third discharge chamber D3 by the dividing sleeve 191*a*.

Herein, the second discharge chamber D2 may be referred to "inner space", and the third discharge chamber D3 may be referred to as "outer space".

In addition, a first guide groove 191*b* and a second guide groove 191*c* may be formed on the inner circumferential surface of the dividing sleeve 191*a*. The first guide groove 191*b* may extend in the longitudinal direction of the dividing sleeve 191*a* to have a predetermined width and length and the second guide groove 191*c* may extend in the circumferential direction of the dividing sleeve 191*a* and may be formed in a strip shape having a predetermined width and length.

At this time, the second guide groove 191*c* may be connected to the first guide groove 191*b* to communicate therewith. Therefore, the refrigerant guided to the second discharge chamber D2 can move in the axial direction (rearward) along the first guide groove 191*b* and in the circumferential direction along the second guide groove 191*c*.

In addition, the inner circumferential surface of the dividing sleeve 191*a* may be formed with a communication groove 191*h* having a depth from the end portion of the dividing sleeve 191*a* to the second guide groove 191*c* in a stepped manner. The communication groove 191*h* communicates with the second guide groove 191*c*.

The communication groove 191*h* can be understood as a passage through which the refrigerant moved in the circumferential direction along the second guide groove 191*c* flows into the third discharge chamber D3.

The communication groove 191*h* may be formed at a position spaced apart from the first guide groove 191*b* in the circumferential direction of the dividing sleeve 191*a*. For example, the communication groove 191*h* may be formed at a position opposite to or facing the first guide groove 191*b*. Therefore, since the time taken for the refrigerant flowing into the second guide groove 191*c* to stay in the second guide groove 191*c* can increase, the pulsation noise of the refrigerant can be effectively reduced.

The first guide groove 191*b* is illustrated as being recessed from the inner circumferential surface of the dividing sleeve 191*a* and extending to the end portion of the dividing sleeve 191*a*. However, in reality, the refrigerant guided to the second discharge chamber D2 may not flow into the second discharge chamber D2 through the first guide groove 191*b*. In other words, when the discharge cover 192 is in close contact with the inside of the cover housing 191, the end portion of the first guide groove 191*b* may be shielded by the outer surface of the discharge cover 192.

However, the first guide groove 191*b* may inevitably extend to the end portion of the dividing sleeve 191*a* due to the aluminum die casting process.

Further, the chamber portion 191*e* may further include a pipe coupling portion 191*n* to which the guide pipe 300 is coupled.

The pipe coupling portion 191*n* may extend outward from the outer circumferential surface of the chamber portion 191*e*. The pipe coupling portion 191*n* includes an accommodation groove 191*u* for accommodating a portion of the guide pipe 300 inward.

The accommodation groove 191*u* may be recessed rearward from the front surface 191*m* of the chamber portion and/or the front surface of the pipe coupling portion 191*n*. In other words, it may be formed by being recessed from the front surface 191*m* of the chamber portion of the accommodation groove 191*u* and may be recessed from the front surface of the pipe coupling portion 191*n*. Alternatively, the accommodation groove 191*u* may extend from the pipe coupling portion 191*n* to the chamber portion 191*e*.

In this implementation, it is described that the accommodation groove 191*u* is formed to extend from the pipe coupling portion 191*n* to the chamber portion 191*e*.

The accommodation groove 191*u* is configured to communicate with the third discharge chamber D3 of the chamber portion 191*e*. For example, a communication groove 191*p* communicating with the third discharge chamber D3 is formed in the pipe coupling portion 191*n* and the communication groove 191*p* extends to the accommodation groove 191*u*. In other words, the communication groove 191*p* is connected to the inner wall 191*y* of the accommodation groove 191*u*, so that the end portion of the communication groove 191*p* can be exposed to the outside through the accommodation groove 191*u*.

In addition, the guide pipe 300 may be detachably coupled to the communication groove 191*p*. For example, the guide pipe 300 may be inserted into the communication groove 191*p* in a state of being accommodated in the accommodation groove 191*u*. To this end, a guide slit 191*v* for insertion of the guide pipe 300 may be formed in the pipe coupling portion 191*n*.

The guide slit 191*v* functions to guide the guide pipe 300 into the accommodation groove 191*u*. To this end, the guide slit 191*v* may be recessed rearward from the front surface of the pipe coupling portion 191*n*. At this time, the guide slit 191*v* may be formed in the inner wall 191*y* of the accommodation groove 191*u* facing the communication groove 191*p*. In other words, the opened portion of the guide slit 191*v* may face the communication groove 191*p*.

On the other hand, the guide slit 191*v* may be formed to penetrate from the outer circumferential surface of the pipe coupling portion 191*n* to the accommodation groove 191*u*. At this time, the guide slit 191*v* may be formed at a position facing the communication groove 191*p*. Accordingly, the guide pipe 300 can be inserted into the communication groove 191*p* after the guide slit 191*v* is linearly moved.

At this time, the length W1 of the guide slit 191*v* in the width direction may be larger than the diameter of the guide pipe 300. In addition, the length W1 of the guide slit 191*v* in the width direction may be larger than the diameter of the communication groove 191*p*. The depth at which the guide slit 191*v* is recessed from the front surface of the pipe coupling portion 191*n* may be greater than or equal to the depth at which the accommodation groove 191*u* is recessed.

With such a configuration, the guide pipe 300 can be inserted into the communication groove 191*p* through the guide slit 191*v*. Therefore, when the guide pipe 300 is inserted into the communication groove 191*p*, the refrigerant in the third discharge chamber D3 can be guided to a side of the guide pipe 300. The refrigerant guided to the guide pipe 300 may be discharged to the outside of the compressor through the discharge pipe 105.

In addition, the chamber portion 191*e* further includes a first recessed portion 191*r* for avoiding interference with the guide pipe 300 in a state where the guide pipe 300 is coupled to the pipe coupling portion 191*n*.

The first recessed portion 191*r* prevents the guide pipe 300 from being in contact with the front surface 191*m* of the chamber portion when the guide pipe 300 is inserted into the communication groove 191*p* and then rotated. To this end, the first recessed portion 191*r* may be recessed rearward from a portion of the front surface 191*m* of the chamber portion. In other words, the first recessed portion 191*r* is stepped from the front surface 191*m* of the chamber portion.

The chamber portion 191*e* may further include a second recessed portion 191*t* for avoiding interference with the guide pipe 300 in a state where the guide pipe 300 is coupled to the pipe coupling portion 191*n*.

The second recessed portion 191*t* is recessed rearward from the front surface 191*m* of the chamber portion, like the first recessed portion 191*r*. At this time, the second recessed portion 191*t* may be recessed deeper than the first recessed portion 191*r*.

Here, the recessed portion relatively adjacent to the pipe coupling portion 191*n* is defined as the first recessed portion 191*r*, and the recessed portion positioned relatively far away can be defined as the second recessed portion 191*t*.

This is because when the guide pipe 300 is completely mounted on the communication groove 191*p*, the guide pipe 300 is arranged in a round manner along the outer circumferential surface of the chamber portion 191*e* from the communication groove 191*p*. Therefore, the guide pipe 300 can be kept in a state of being spaced from the front surface 191*m* of the chamber portion 191*e*.

In some implementations, the support device fixing portion 191*d* may extend in the axial direction of the shell 101 from the front surface 191*m* of the chamber portion. For example, the support device fixing portion 191*d* may extend from the front surface 191*m* of the chamber portion to a cylindrical shape having an outer diameter smaller than the outer diameter of the chamber portion 191*e*.

The end portions of a pair of first support devices 200 are respectively coupled to the outer circumferential surfaces of the support device fixing portions 191*d*. To this end, a fastening groove 191*w* is formed in the outer circumferential surface of the support device fixing portion 191*d*, into which a portion of the first support device 200 is inserted.

In some examples, the fastening groove 191*w* includes a pair of fastening grooves 191*w* for coupling a pair of first support devices 200 on a side surface portion of the support device fixing portion 191*d*, that is, a surface forming a cylindrical portion (hereinafter defined to as a circumferential surface). The pair of fastening grooves 191*w* may be formed on a position spaced apart by a predetermined angle along the circumferential surface of the support device fixing portion 191*d*. The fastening groove 191*w* may be formed to penetrate from the circumferential surface of the support device fixing portion 191*d* toward the central portion of the support device fixing portion 191*d*. For example, the fastening groove 191*w* may have a circular cross-sectional shape but is not limited thereto.

With reference to FIG. 8, the length L2 in the direction in which the chamber portion 191*e* extends forward can be longer than the length L3 in the direction in which the support device fixing portion 191*d* extends forward. In other words, the length L2 from the rear end portion to the front end portion of the chamber portion 191*e* may be longer than the length L3 from the rear end portion to the front end portion of the support device fixing portion 191*d*. Therefore, it is possible to secure a discharge space sufficient for the chamber portion 191*e* to reduce the pulsation noise of the refrigerant.

The length L1 from the rear end portion to the front end portion of the flange portion 191*f* may be shorter than the length L3 from the rear end portion to the front end portion of the support device fixing portion 191*d*.

Here, the guide pipe 300 may be positioned in a region between a line passing through the front surface 191*m* of the chamber portion 191*e* and a line passing through the front surface of the first recessed portion 191*r*. In other words, when the guide pipe 300 is mounted on the pipe coupling portion 191*n*, the guide pipe 300 maintains a predetermined height from the first recessed portion 191*r*.

A hooking jaw 191*g* may be formed on the inner circumferential surface of the rear end of the chamber portion 191*e* so that the rear end portion of the discharge cover 192 is hooked in a stepped manner.

Hereinafter, the discharge cover 192 will be described in detail.

The discharge cover 192 may include a flange 192*e* whose outer edge is caught by the hooking jaw 191*g*, a seating portion bent at the inner edge of the flange 192*e* to seat the valve spring assembly 240, a cover main body 192*d* extending from the front surface of the seating portion 192*a*, and a bottle neck portion 192*f* extending from a central portion of the cover main body 192*d* to an inner space of the cover main body 192*d*. Here, the flange 192*e* of the discharge cover 192 may be referred to as "cover flange".

In detail, the flange 192*e* is a member inserted into the hooking jaw 191*g* formed in the cover housing 191. In one example, the flange 192*e* may be formed as a hollow circular or oval shape. The flange 192*e* is fitted inside the rear end of the chamber portion 191*e*.

The seating portion 192*a* may include a second portion 192*c* that is bent forward at the inner edge of the flange 192*e* and a first portion 192*b* that is bent at the front end of the second portion 192*c* toward the center of the discharge cover 192. The cover main body 192*d* may be bent forward at the inner edge of the first portion 192*b* and then bent toward the center of the discharge cover 192.

On the other side, the sectional structure of the discharge cover 192 can be described that the bottle neck portion 192*f* extends from the center of the front surface of the cover main body 192*d* to the inside of the discharge cover 192 and is radially extended from the rear end portion of the cover main body 192*d* in the radial direction, the second portion 192*c* extends in the axial direction from the outer edge of the first portion 192*b*, and the flange 192*e* extends from the rear end of the second portion 192*c* in the radial direction.

The inner space of the cover main body 192*d* may be defined as a first discharge chamber D1 and a discharge hole 192*g* through which the refrigerant discharged from the first discharge chamber D1 passes may be formed on the rear end of the bottle neck portion 192*f*.

Here, the first discharge chamber D1 may be referred to as "accommodation portion".

In detail, when the discharge cover 192 is inserted into the cover housing 191, the front surface of the seating portion 192*a* is in contact with the end of the partition sleeve 191*a*. At this time, the second discharge chamber D2 can be shielded by being the front surface of the seating portion 192*a* into close contact with the end portion of the dividing sleeve 191*a*.

However, since the communication groove 191*h* formed at the end portion of the dividing sleeve 191*a* is in a state of being spaced apart from the seating portion 192*a*, the refrigerant guided to the second discharge chamber D2 can flow into the third discharge chamber D3 through the communication groove 191*h*.

The outer circumferential surface of the cover main body 192*d* may be spaced apart from the first guide groove 191*b* by a predetermined distance. Therefore, the refrigerant guided to the second discharge chamber D2 can be guided to the first guide groove 191*b* and flow into the second guide groove 191*c*.

In addition, the front portion of the valve spring assembly 240 is seated on the first portion 192*b* and the friction ring 243 is in contact with the second portion 192*c* to generate a frictional force.

The depth and/or width of the spring support portion 241 are formed to be smaller than the diameter of the friction ring 243 so that the outer edge of the friction ring 243 protrudes from the outer circumferential surface of the spring support portion 241. Then, when the valve spring assembly 240 is seated on the seating portion 192*a*, the friction ring 243 is pressed by the second portion 192*c* to deform the circular cross-section into an elliptical cross-section, as a result, a predetermined frictional force may be generated as the contact area with the second portion 192*c* becomes wider. Thereby, a gap is not formed between the second portion 192*c* and the outer circumferential surface of the spring support portion 241, and the frictional force prevents the valve spring assembly 240 from idling in the circumferential direction.

In addition, since the spring support portion 241 does not directly hit the discharge cover 192, for example, the second portion 192*c* by the friction ring 243, the generation of impact noise can be minimized.

In addition, the gasket 210 is interposed between the first portion 192*b* and the front surface of the spring support portion 241 to prevent the spring support portion 241 from directly hitting the first portion 192*b*.

In addition, the outer edge of the valve spring 242 can be inserted into the spring support portion 241 and the outer edge of the valve spring 242 is positioned at a position closer to the rear than the front surface of the spring support portion 241. The front center portion of the discharge valve 161 may be inserted into the center of the valve spring 242.

In addition, the discharge cover 192 further includes a discharge cover support portion 192*y* that extends forward along the outer edge of the flange 192*e* and is in close contact with the inner circumferential surface of the cover housing 191.

In detail, the flange 192*e* may be formed in a circular or oval shape, and the discharge cover support portion 192*y* may extend forward along the outer edge of the flange 192*e*. Therefore, the discharge cover support portion 192*y* may have a hollow cylindrical shape. For example, the outer diameter of the discharge cover support portion 192*y* may be designed to correspond to the inner diameter of the cover housing 191.

The outer circumferential surface of the discharge cover support portion 192*y* is in close contact with the inner circumferential surface of the cover housing 191 to generate a frictional force on the contact surface between the cover housing 191 and the discharge cover 192. Therefore, since the discharge cover 192 can be tightly coupled to the cover housing 191, it is possible to prevent the discharge cover 192 from being separated from the inside of the cover housing 191 or idling.

In addition, as described above, the cover housing 191 is made of aluminum material and the discharge cover support portion 192*y* is made of a plastic material so that the heat of the cover housing 191 is transferred to the frame 110 The conduction can be minimized. In other words, the discharge cover support portion 192*y* may serve as a heat insulating material between the cover housing 191 and the frame 110.

In some implementations, the refrigerant discharged from the compression space P by the opening of the discharge valve 161 passes through the slits formed in the valve spring 242 and is guided to the first discharge chamber D1. For example, to open the discharge valve 161, the discharge valve 161 may move in a direction approaching the rear end of the bottle neck portion 192*f* by elastic deformation of the valve spring 242, and the front surface of the compression space P may be opened.

The refrigerant guided to the first discharge chamber D1 is guided to the second discharge chamber D2 through a discharge hole 192*g* formed at the rear end of the bottle neck portion 192*f*. Here, since the discharge hole is formed in the bottle neck portion 192*f* as compared with the structure in which the discharge hole is formed on the front surface of the cover main body 192*d*, the pulsation noise of the refrigerant can be remarkably reduced. In other words, the refrigerant in the first discharge chamber D1 is discharged to the second discharge chamber D2 having a large cross-sectional area after passing through the bottle neck portion 192*f* having a narrow cross-sectional area, and thus the noise due to pulsation of the refrigerant is remarkably reduced.

In addition, the refrigerant guided to the second discharge chamber D2 moves in the axial direction along the first guide groove 191*b* and moves in the circumferential direction along the second guide groove 191*c*. The refrigerant moving in the circumferential direction along the second guide groove 191*c* is guided to the third discharge chamber D3 through the communication groove 191*h*.

Here, in a process of discharging the refrigerant which flows along the first guide groove 191*b*, the second guide groove 191*c*, and the communication groove 191*h* having a narrow cross-sectional area to the third discharge chamber D3 having a large sectional area, the pulsation noise of the refrigerant is reduced once more.

The refrigerant guided to the third discharge chamber D3 is discharged to the outside of the compressor through the guide pipe 300.

Figure 9:
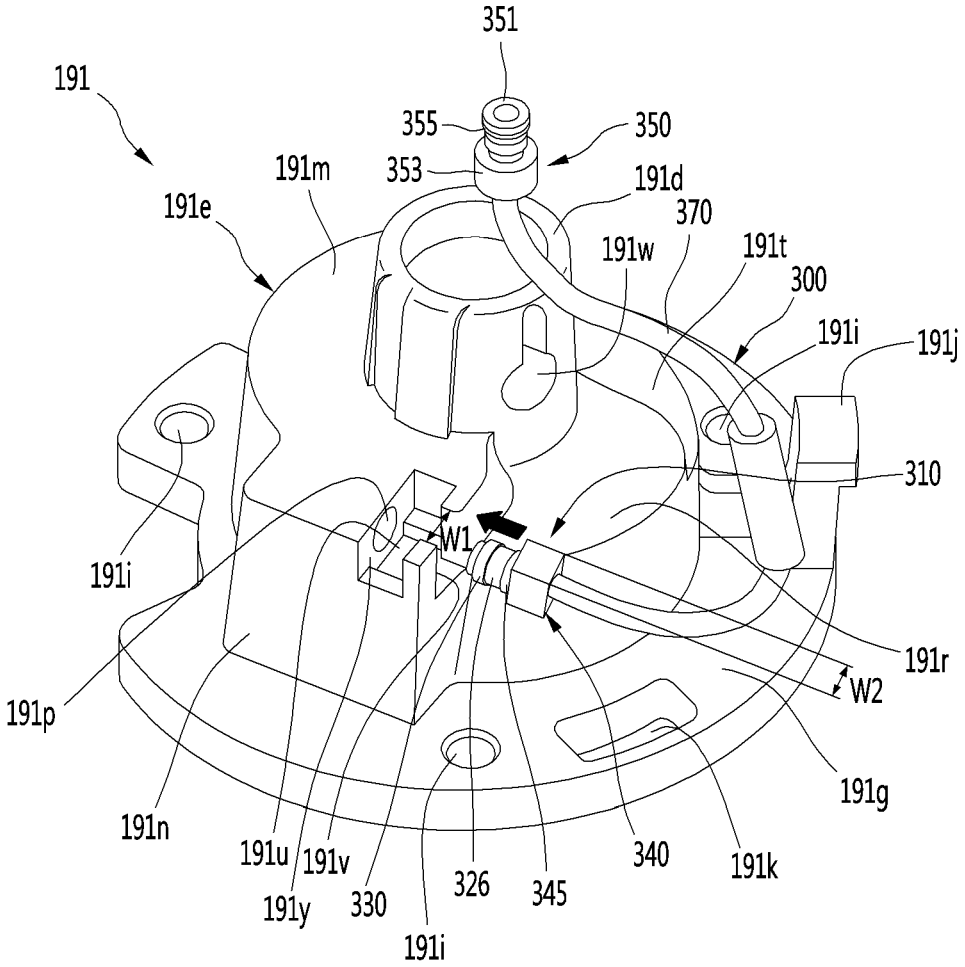
FIG. 9 is a view illustrating a state of an example guide pipe before the guide pipe is coupled to an example discharge cover unit.
Figure 10:
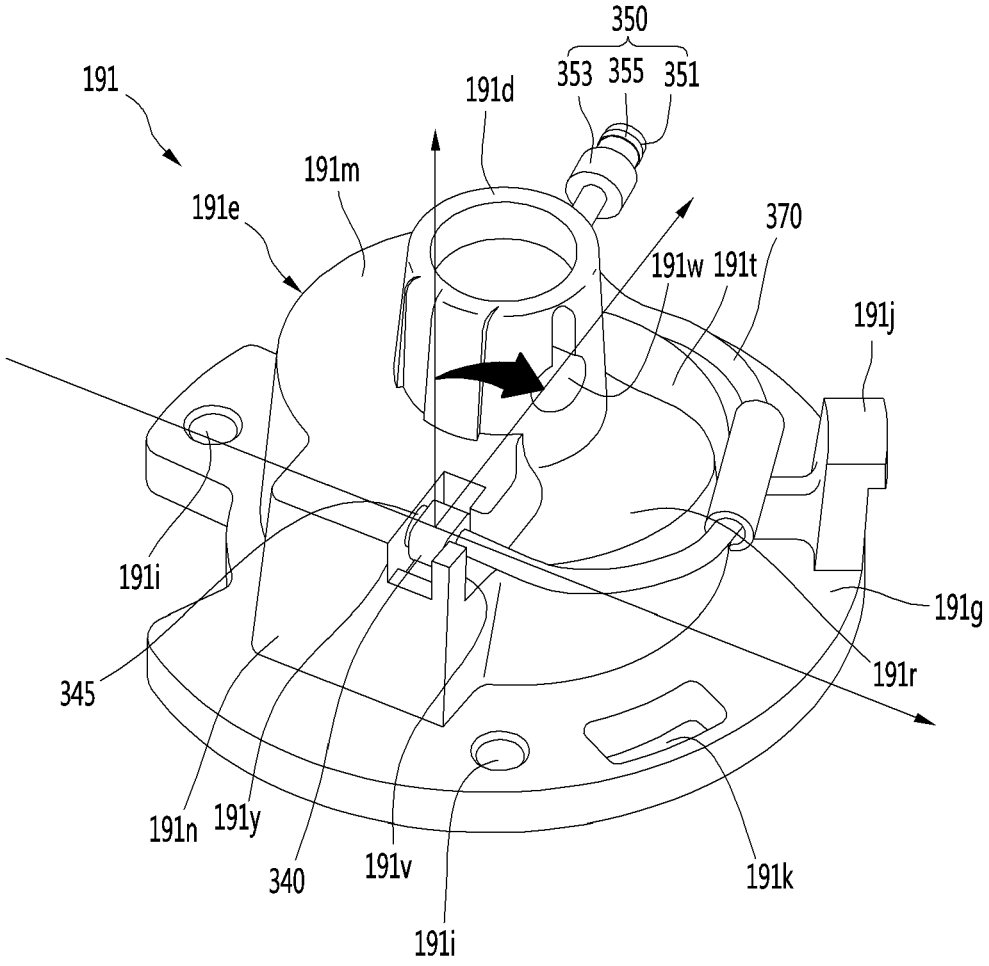
FIG. 10 is a view illustrating a state of an example guide pipe where the guide pipe is coupled to an example discharge cover unit.
Figure 11:
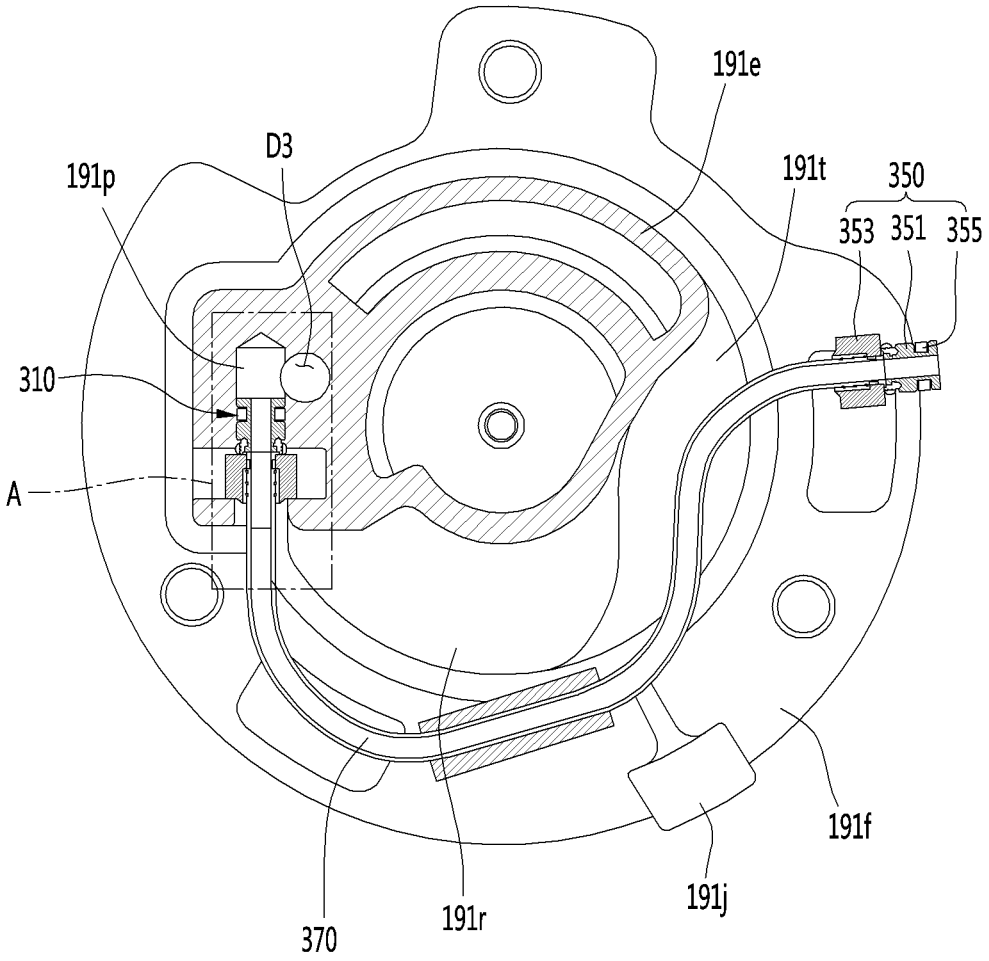
FIG. 11 is a cross-sectional view illustrating a state of an example guide pipe where the guide pipe is coupled to an example discharge cover unit.
Figure 12:
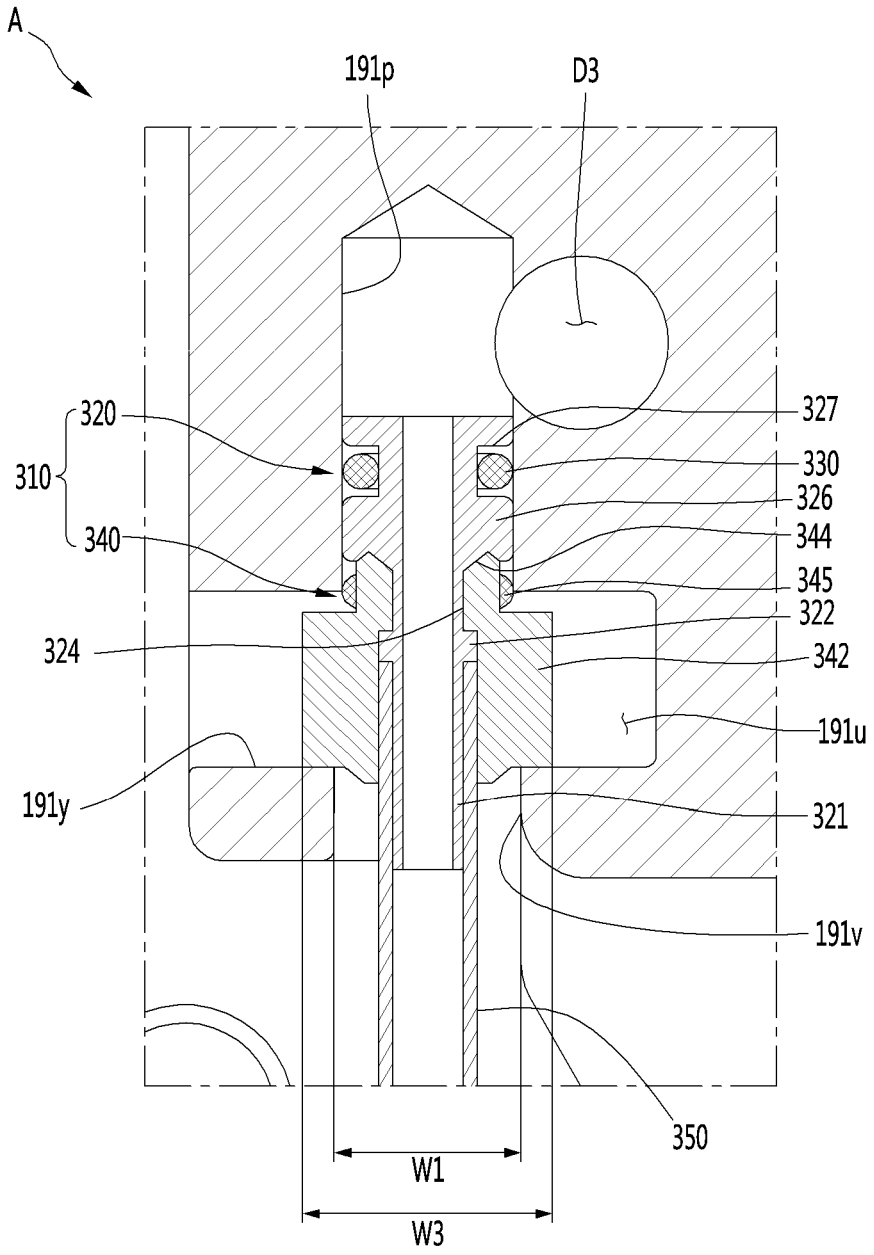
FIG. 12 is an enlarged view of "A" in FIG. 11.

Hereinafter, the structure and the coupling method of the guide pipe 300 will be described in detail with reference to the drawings, FIG. 9 is a view illustrating an example state before an example guide pipe is coupled to an example discharge cover unit, FIG. 10 is a view illustrating an example state where the guide pipe is coupled to the discharge cover unit, FIG. 11 is a cross-sectional view illustrating an example state where the guide pipe is coupled to the discharge cover unit and FIG. 12 is an enlarged view of "A" in FIG. 11.

With reference to FIGS. 9 to 12, the guide pipe 300 includes a first coupling portion 310 coupled to the cover housing 191, a second coupling portion 350 coupled to the discharge pipe 105 of the shell, and a connection pipe 370 connecting the first and second coupling portions 310 and 350 to each other.

The connection pipe 370 is formed of a flexible material and forms a space through which refrigerant flows, therein. One end portion of the connection pipe 370 is provided with a first coupling portion 310 and the other end portion thereof is provided with a second coupling portion 350. Therefore, the refrigerant guided to the first coupling portion 310 can be moved to the second coupling portion 350 through the connection pipe 370. The refrigerant may be discharged to the discharge pipe 105 through the second coupling portion 350.

The first coupling portion 310 is provided at one end portion of the connection pipe 370 and connects the connection pipe 370 and the communication groove 191*p*. To this end, the first coupling portion 310 includes a connection member 320, a portion of which is inserted into the connection pipe 370 and another portion of which is inserted into the communication groove 191*p*.

The connection member 320 may include an insertion portion 321 inserted into the connection pipe 370. A stopper 322 protruding from the insertion portion 321 in the radial direction is provided at a position spaced from the end portion of the insertion portion 321 by a predetermined distance.

When the insertion portion 321 is inserted into the connection pipe 370, the stopper 322 restricts the insertion of the insertion portion 321 in a state where the insertion portion 321 is inserted by a predetermined length. For example, one stopper 322 may be continuously formed in the circumferential direction of the connection member 320, or a plurality of stoppers 322 may be disposed so as to be spaced apart from each other in the circumferential direction of the connection member 320.

At this time, in order to prevent the insertion portion 321 from being detached from the connection pipe 370 in a state where the insertion portion 321 of the connection member 320 is inserted into the connection pipe 370, a separation prevention protrusion may be provided on the outer circumferential surface of the connection pipe 370 and a protrusion accommodation groove may be provided on the inner circumferential surface of the connection pipe 370 to accommodate the separation prevention protrusion.

In addition, the first coupling portion 310 may further include a pipe cover 340 surrounding the connection pipe 370 into which the connection member 320 is inserted. The pipe cover 340 functions to strongly hold the connection member 320 so that the connection member 320 is not separated from the connection pipe 370.

The pipe cover 340 may be integrally formed with the connection pipe 370 by inserting injection in a state where the insertion portion 321 of the connection member 320 is inserted into the connection pipe 370. The connection pipe 370 and the pipe cover 340 may be made of nylon material, although not limited thereto.

At this time, the pipe cover 340 formed by inserting injection not only may surround a portion of the connection pipe 370 but also may surround a portion of the connection member 320. In other words, the pipe cover 340 may include a first cover 342 covering the connection pipe 370, and a second cover 344 extending from the first cover 342 and covering the connection member 320.

The outer diameter of the first cover 342 is larger than the outer diameter of the second cover 344. In other words, the pipe cover 340 may be stepped. This is because the first cover 342 restricts the insertion of the connection member 320 in a state where the connection member 320 is inserted into the communication groove 191*p* by a predetermined depth.

In this implementation, the first cover 342 may have a polyhedral shape. For example, the first cover 342 may be formed as a hexahedron having a horizontal diameter W2 having a predetermined length and a vertical diameter W3 having a diameter larger than the horizontal diameter W2.

At this time, the transverse diameter W2 of the first cover 342 is formed to be smaller than the width W2 of the guide slit 191*v* of the pipe coupling portion 191*n*. Therefore, the guide pipe 300 can be inserted into the communication groove 191*p* through the guide slit 191*v*.

The vertical diameter W3 of the first cover 342 is larger than the horizontal diameter W2 thereof and is larger than the width W1 of the guide slit 191*v*. Accordingly, the first cover 342 of the guide pipe 300 can be inserted into the communication groove 191*p* by passing through the guide slit 191*v* in an erected state.

When the first coupling portion 310 inserted into the communication groove 191*p* is rotated by a predetermined angle (for example, 90 degrees), the first cover 342 can be prevented from falling to the outside through the guide slit 191*v* by the vertical diameter W3 of the first cover 342.

In addition, the connection member 320 may further include a coupling portion 326 inserted into the communication groove 191*p*.

The coupling portion 326 extends from the insertion portion 321 and the outer diameter of the coupling portion 326 is formed to be larger than the outer diameter of the insertion portion 321. The stopper 322 is disposed at a position spaced apart from the coupling portion 326. By the positional relationship between the stopper 322 and the coupling portion 326 and the difference in diameter between the inserting portion 321 and the coupling portion 326, a portion of the pipe cover 340 surrounds the connection member 320 between the stopper 322 and the coupling portion 326.

The second cover 344 of the pipe cover 340 may be positioned between the stopper 322 and the coupling portion 326. The first cover 342 of the pipe cover 340 may surround the stopper 322.

When the second cover 334 of the pipe cover 340 is positioned between the stopper 322 and the coupling portion 326, separation of the connection member 320 from the pipe cover 340 can be prevented.

The connection member 320 may further include a cover seating portion 324 on which the pipe cover 340 is seated. At this time, the outer diameter of the cover seating portion 324 may be equal to or smaller than the outer diameter of the insertion portion 321. In a case where the outer diameter of the cover seating portion 324 is smaller than the outer diameter of the inserting portion 321, the contact area between the stopper 322 and the second cover 534 in the longitudinal direction of the connection member 320 increases and thus it can be effectively prevented that the connection member 320 is separated from the pipe cover 340.

The coupling portion 326 is formed with a sealing member seating groove 327 which is recessed along the periphery of the outer circumferential surface. A sealing member 330 is seated in the sealing member seating groove 327. The sealing member 330 may be an O-ring, for example.

When the guide pipe 300 is inserted into the communication groove 191*p*, the sealing member 330 is inserted into the communication groove 191*p* while being elastically deformed. When the insertion of the guide pipe 300 is completed, the sealing member 330 is elastically restored and is in close contact with the inner circumferential surface of the communication groove 191*p*. Therefore, since the airtightness between the communication groove 191*p* and the guide pipe 300 is maintained, the occurrence of refrigerant leakage can be prevented.

In addition, the first coupling portion 310 may further include an elastic member 345 surrounding the outer circumferential surface of the second cover 344. The elastic member 345 may be ring-shaped.

For example, the elastic member 345 serves to restrict the rotation of the first coupling portion 310 in a case where the first coupling portion 310 is inserted into the communication groove 191*p*.

For example, at least a portion of the elastic member 345 may be inserted into the communication groove 191*p* in a state where the elastic member 345 is fitted to the outer circumferential surface of the second cover 344. In other words, at least a portion of the elastic member 345 is elastically deformed and inserted into the communication groove 191*p* to be in close contact with the communication groove 191*p* while the first coupling portion 310 is inserted into the communication groove 191*p*.

Then, the circular cross-section of the elastic member 345 is deformed into an elliptical cross-section, and a portion of the elastic member 345 exposed in the accommodation groove 191*u* generates a pressing force for pressing outward. In other words, when the elastic member 345 is compressed, the elastic member 345 is elastically deformed to move the first coupling portion 310 in the pulling direction, and as a result, the rear end portion of the second cover 344 is in close contact with the inner side wall 191*y* of the accommodation groove 191*u*.

According to the above-described configuration, a pulling amount which is pulled in the first coupling portion 310 into the communication groove 191*p* can be adjusted. In addition, since the second cover 344 is positioned in close contact with the accommodation groove 191*u*, the first coupling portion 310 can be strongly inserted into the communication groove 191*p* without being separated from the communication groove 191*p*, a frictional force against the rotation of the first coupling portion 310 may occur.

When the first coupling portion 310 is inserted into the communication groove 191*p*, the guide pipe 300 is rotated toward the discharge pipe 105 so that the second coupling portion 350 can be connected to the discharge pipe 105.

In some implementations, since the structure of the second coupling portion 350 is the same as that of the related art, it will be briefly described.

The second coupling portion 350 is provided at the other end portion of the connection pipe 370 and connects the connection pipe 370 and the discharge pipe 105. To this end, the second coupling portion 350 may include a connection member 351, a portion of which is inserted into the connection pipe 370 and another portion of which is inserted into the discharge pipe 105.

The second coupling portion 350 may further include a pipe cover 353 surrounding the connection pipe 370 into which the connection member 351 is inserted. The pipe cover 353 functions to strongly hold the connection member 351 so that the connection member 351 is not separated from the connection pipe 370.

In addition, the second coupling portion 35 may further include a sealing member 355 that is seated in a seating groove recessed along the circumferential direction on the outer circumferential surface of the connection member 351.

Hereinafter, how the first coupling portion 310 of the guide pipe 300 is coupled to the communication groove 191*p* of the cover housing 191 will be described.

First, the first coupling portion 310 is aligned to face the communication groove 191*p*. At this time, as illustrated in FIG. 9, the pipe cover 340 is raised so that the pipe cover 340 passes through the guide slit 191*v*.

The first coupling portion 310 is moved in a direction to be inserted into the communication groove 191*p* so that the connection member 320 of the first coupling portion 310 is inserted into the communication groove 191*p*. The insertion portion 321 of the connection member 320 is inserted into the communication groove 191*p* and the pipe cover 340 is in a state of being accommodated in the accommodation groove 191*u*.

The elastic member 345 is hooked between the communication groove 191*p* and the front end portion of the second cover 344 while the connection member 320 and a portion of the second cover 344 are inserted into the communication groove 191*p*.

In some implementations, the first coupling portion 310 is moved backward in the opposite direction of the inserting direction by the restoring force of the elastic member 345, and the rear end portion of the first cover 342 is in close contact with the side wall 191*y*. With such a configuration, the first coupling portion 310 is not pushed further rearward, so that the first coupling portion 310 can be strongly coupled to the communication groove 191*p*.

Then, as illustrated in FIG. 10, the guide pipe 300 is rotated toward the opposite side of the pipe coupling portion 191*n*, that is, toward a side of the discharge pipe 105. In the present implementation, the guide pipe 300 can be rotated by 90 degrees in the circumferential direction in a state of being inserted into the communication groove 191*p*.

When the guide pipe 300 is rotated, the pipe cover 340 is in a state of lying, not in a state of being erected, and the pipe cover 340 is prevented from coming out of the accommodation groove 191*u* by the vertical diameter W3 of the first cover 342.

With reference to FIG. 11, in a case where the guide pipe 300 is rotated at a predetermined angle (for example, 90 degrees) in a state where the guide pipe 300 is mounted on the communication groove 191*p*, the connection pipe 370 is positioned above the chamber portion 191*e* along the outer circumferential surface of the chamber portion 191*e*. At this time, the connection pipe 370 is prevented from being in contact with the chamber portion 191*e* by the stepped structure of the first recessed portion 191*r* and the second recessed portion 191*t*.

In other words, even if the connection pipe 370 is rotated in a state where the guide pipe 300 is inserted into the communication groove 191*p*, since the connection pipe 370 is disposed to be spaced apart from the stepped portion of the chamber portion 191*e*, that is, the upper portions of the first recessed portion 191*r* and the second recessed portion 191*t*, interference between the connection pipe 370 and the chamber portion 191*e* can be avoided.

When the guide pipe 300 is rotated and the second coupling portion 350 is coupled to the discharge pipe 105, mounting of the guide pipe 300 is completed.

In some implementations, when the compressor main body is started, while the elastic member 345 receives heat from the refrigerant discharged from the cover housing 191 and expands, the first coupling portion 310 is more strongly in close contact with the inside of the accommodation groove 191*u*. Then, it can be more reduced that the possibility that the first coupling portion 310 is separated from the communication groove 191*p*.

Also, since the space between the communication groove 191*p* and the first coupling portion 310 is secondarily sealed by the elastic member 345, the leakage of the refrigerant can be prevented secondarily.

The linear compressor according to the implementation of the present disclosure configured as described above has the following effects.

Firstly, since the guide pipe can be tightly fixed to the housing cover, the airtightness between the housing cover and the guide pipe is maintained and the leakage of the refrigerant is prevented.

Secondly, since the guide pipe can be firmly mounted on the accommodation groove formed in the cover housing in a state of being inserted to be in close contact with the accommodation groove, the guide pipe is prevented from being detached from the cover housing.

Thirdly, since the installation of the guide pipe is completed only by rotating the guide pipe after the guide pipe is inserted into the communication groove of the cover, no separate components and processes for fixing the guide pipe are required, and there is an advantage that the working time for installing the guide pipe is greatly reduced.

Fourthly, even if the cover housing is not made of steel material, airtightness between the cover housing and the cover pipe can be easily maintained, resulting in a lower product cost and superior general versatility.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell;

a discharge pipe coupled to the shell and configured to discharge refrigerant;

a compressor main body located inside of the shell and configured to compress refrigerant;

a cover housing that defines a discharge space configured to receive refrigerant from the compressor main body and to discharge refrigerant to the discharge pipe; and a guide pipe coupled to the cover housing and configured to guide refrigerant from the discharge space to the discharge pipe, wherein the cover housing includes:

a flange portion configured to couple to the compressor main body, a chamber portion that extends from the flange portion and that defines the discharge space, the chamber portion having a front surface that is closed, an accommodation groove recessed rearward from the front surface of the chamber portion and configured to accommodate the guide pipe, and a communication groove that penetrates an inner wall of the accommodation groove and that extends to the discharge space, and wherein the guide pipe is configured to insert into the communication groove in a state in which the guide pipe is accommodated in the accommodation groove.

2. The linear compressor according to claim 1, wherein the chamber portion comprises a pipe coupling portion that extends outward from an outer circumferential surface of the chamber portion and that defines at least a portion of the accommodation groove.

3. The linear compressor according to claim 2, wherein the guide pipe is configured to, based on passing through a portion of the pipe coupling portion, insert into the accommodation groove.

4. The linear compressor according to claim 3, wherein the pipe coupling portion defines a guide slit that extends from the outer circumferential surface of the chamber portion to the accommodation groove and that is configured to guide the guide pipe into the accommodation groove.

5. The linear compressor according to claim 4, wherein the guide slit faces the communication groove.

6. The linear compressor according to claim 4, wherein the guide pipe includes:

a first coupling portion configured to insert into the communication groove;

a second coupling portion configured to insert into the discharge pipe; and a connection pipe that connects the first coupling portion to the second coupling portion, and wherein the first coupling portion is configured to be accommodated in the accommodation groove through the guide slit.

7. The linear compressor according to claim 6, wherein the first coupling portion includes:

a connection member having a first portion configured to insert into the communication groove and a second portion configured to insert into the connection pipe;

a pipe cover that surrounds a periphery of the connection member based on insertion of the connection member into the connection pipe; and an elastic member located between the connection member and the pipe cover.

8. The linear compressor according to claim 7, wherein the elastic member is located at a circumferential surface of the pipe cover that surrounds the periphery of the connection member.

9. The linear compressor according to claim 7, wherein the elastic member has a first portion configured to insert into the communication groove and a second portion configured to be exposed to the accommodation groove.

10. The linear compressor according to claim 8, wherein the pipe cover includes:

a first cover that surrounds a portion of the connection pipe; and a second cover that extends from the first cover and that surrounds a portion of the connection member, wherein an outer diameter of the first cover is greater than an outer diameter of the second cover, and wherein the elastic member is configured to couple to an outer circumferential surface of the second cover.

11. The linear compressor according to claim 10, wherein a portion of the second cover is configured to insert into the communication groove, and wherein the elastic member is configured to be positioned between the outer circumferential surface of the second cover and an inner circumferential surface of the communication groove.

12. The linear compressor according to claim 11, wherein the pipe cover is configured to, based on insertion of the first coupling portion into the communication groove, contact the inner wall of the accommodation groove by elastic force applied by the elastic member.

13. The linear compressor according to claim 10, wherein the first cover has a polyhedral shape having a first width in a first direction and a second width in a second direction, the second width being greater than the first width, and wherein a width of the guide slit is greater than the first width and less than the second width.

14. The linear compressor according to claim 1, wherein the guide pipe has a first end portion configured to insert into the communication groove and a second end portion configured to insert into the discharge pipe, wherein the guide pipe is configured to rotate with respect to the accommodation groove by a predetermined angle in a state in which the first end portion is inserted into the communication groove, and wherein the second end portion is configured to insert into the discharge pipe in a state in which the first end portion is inserted into the communication groove.

15. The linear compressor according to claim 14, wherein the front surface of the chamber portion defines a recessed portion that is configured to receive the guide pipe arranged about the chamber portion and that allows the guide pipe to avoid interference with the chamber portion.

16. The linear compressor according to claim 1, wherein the cover housing is manufactured by aluminum die-casting.

17. The linear compressor according to claim 1, wherein the compressor main body includes one or more of:

a frame located inside of the shell, the frame comprising a frame head and a frame body that extends from a center of a rear surface of the frame head in a longitudinal direction of the shell;

a cylinder configured to insert into the frame body through the frame head, the cylinder defining a compression space at a front end portion of the cylinder;

a piston located inside of the cylinder and configured to move relative to the cylinder to compress refrigerant in the compression space;

a motor assembly configured to drive the piston to move relative to the cylinder in an axial direction of the cylinder; and a discharge valve located at a front surface of the cylinder and configured to selectively open and close at least a portion of the compression space.

18. The linear compressor according to claim 17, further comprising a discharge cover configured to insert into a rear surface of the cover housing and configured to cover an opening defined at the rear surface of the cover housing, wherein the compressor main body further includes a valve spring assembly configured to insert inside of the discharge cover and configured to provide elastic force that causes the discharge valve to contact the front surface of the cylinder.

19. The linear compressor according to claim 1, wherein the chamber portion of the cover housing defines an opening at a rear surface of the chamber portion that faces a front surface of the compressor main body.

20. The linear compressor according to claim 1, wherein the cover housing partitions the discharge space into a plurality of discharge chambers that communicate with each other, and wherein the discharge pipe is configured to connect to at least one of the plurality of discharge chambers.

* * * * *